US010982173B2

(12) United States Patent
Blondeau et al.

(10) Patent No.: US 10,982,173 B2
(45) Date of Patent: Apr. 20, 2021

(54) FRAGRANCE COMPOSITIONS

(71) Applicant: Givaudan SA, Vernier (CH)

(72) Inventors: Philippe Blondeau, Paris (FR); Alice Bresson Boil, Herblay (FR); Maxence Moutte, Paris (FR); Celine Ropartz-Lebel, Taverny (FR)

(73) Assignee: Givaudan SA, Vernier (CH)

( * ) Notice: Subject to any disclaimer, the term of this patent is extended or adjusted under 35 U.S.C. 154(b) by 0 days.

(21) Appl. No.: 16/329,764

(22) PCT Filed: Sep. 13, 2017

(86) PCT No.: PCT/EP2017/073062
§ 371 (c)(1),
(2) Date: Feb. 28, 2019

(87) PCT Pub. No.: WO2018/050721
PCT Pub. Date: Mar. 22, 2018

(65) Prior Publication Data

US 2019/0218476 A1 Jul. 18, 2019

(30) Foreign Application Priority Data

Sep. 14, 2016 (GB) ..... 1615581

(51) Int. Cl.

| | |
|---|---|
| ***A61K 8/18*** | (2006.01) |
| ***A61Q 13/00*** | (2006.01) |
| ***A61K 8/00*** | (2006.01) |
| ***C11B 9/00*** | (2006.01) |
| ***C11D 3/50*** | (2006.01) |
| *C11B 9/02* | (2006.01) |

(52) U.S. Cl.
CPC ..... *C11B 9/008* (2013.01); *C11B 9/00* (2013.01); *C11D 3/50* (2013.01); *C11B 9/025* (2013.01)

(58) Field of Classification Search
CPC ..... C11B 9/0089; C11B 9/025; C11B 9/00; C11D 3/50
USPC ..... 512/11, 8, 1
See application file for complete search history.

(56) References Cited

U.S. PATENT DOCUMENTS

| | | | |
|---|---|---|---|
| 5,508,259 | A | 4/1996 | Holzner et al. |
| 5,614,484 | A | 3/1997 | Panandiker |
| 6,184,419 | B1 | 2/2001 | Berg-Schultz et al. |
| 6,998,382 | B2 | 2/2006 | Yang et al. |
| 2002/0037817 | A1 | 3/2002 | Foley et al. |
| 2003/0069155 | A1 | 4/2003 | Mangin et al. |
| 2003/0166497 | A1 | 9/2003 | Yang et al. |
| 2004/0175404 | A1 | 9/2004 | Shefer et al. |
| 2004/0221858 | A1 | 11/2004 | Higashi et al. |
| 2008/0221003 | A1 | 9/2008 | Meine et al. |
| 2009/0257974 | A1* | 10/2009 | Evans ..... A61L 15/20 424/76.6 |
| 2011/0020516 | A1 | 1/2011 | Jouichi et al. |
| 2013/0039876 | A1 | 2/2013 | Perring et al. |
| 2013/0039877 | A1 | 2/2013 | Perring et al. |
| 2015/0079017 | A1 | 3/2015 | Perring et al. |
| 2015/0164764 | A1 | 6/2015 | Bonnet et al. |
| 2015/0182656 | A1 | 7/2015 | Perring et al. |
| 2017/0290757 | A1 | 10/2017 | Fadel et al. |
| 2019/0241832 | A1* | 8/2019 | Provan ..... C11D 3/50 |

FOREIGN PATENT DOCUMENTS

| | | | |
|---|---|---|---|
| EP | 1 067 118 | A1 | 1/2001 |
| EP | 1 336 346 | A1 | 8/2003 |
| EP | 1 721 838 | A2 | 11/2006 |
| EP | 2 196 525 | A1 | 6/2010 |
| WO | WO 92/11352 | A1 | 7/1992 |
| WO | WO 93/04158 | A1 | 3/1993 |
| WO | WO1993004158 | * | 3/1993 |
| WO | WO 97/34988 | A1 | 9/1997 |
| WO | WO 99/65458 | A1 | 12/1999 |
| WO | WO 02/06437 | A1 | 1/2002 |
| WO | WO 02/064723 | A2 | 8/2002 |
| WO | WO 02/090486 | A1 | 11/2002 |
| WO | WO 2005/055964 | A1 | 6/2005 |
| WO | WO 2007/028477 | A1 | 3/2007 |
| WO | WO 2008/017820 | A1 | 2/2008 |
| WO | WO 2009/031505 | A1 | 3/2009 |
| WO | WO 2011/033047 | A1 | 3/2011 |
| WO | WO 2015/089246 | A1 | 6/2015 |

(Continued)

OTHER PUBLICATIONS

PCT/EP2017/073062—International Search Report, dated Nov. 2, 2017.

(Continued)

*Primary Examiner* — Jessica Whiteley

(74) *Attorney, Agent, or Firm* — Curatolo Sidoti Co., LPA; Salvatore A. Sidoti

(57) ABSTRACT

A perfume composition providing differentiated odour depending on the assessment conditions is provided. The perfume composition includes a) less than 20% by weight of perfumery ingredients having an equilibrium headspace concentration (HS) between 151 and 900 microgram/l at 25° C., b) at least 35% by weight of perfumery ingredients having a HS higher than 900 microgram/l at 25° C. and b) 25% by weight of perfumery ingredients having a HS lower than or equal to 150 microgram/l at 25° C. The perfume composition reduces consumer perfume habituation to said perfume product.

20 Claims, 1 Drawing Sheet

(56) References Cited

FOREIGN PATENT DOCUMENTS

WO WO-2015089246 A1 * 6/2015 ..... A61K 8/342
WO WO 2016/058710 A1 4/2016

OTHER PUBLICATIONS

PCT/EP2017/073062—International Written Opinion, dated Nov. 2, 2017.
Etzweiler, F.; Eine einfache Methode zur Bestimmung von Dampfdrucken, Phys. Chem., 1984, pp. 578-583.

* cited by examiner

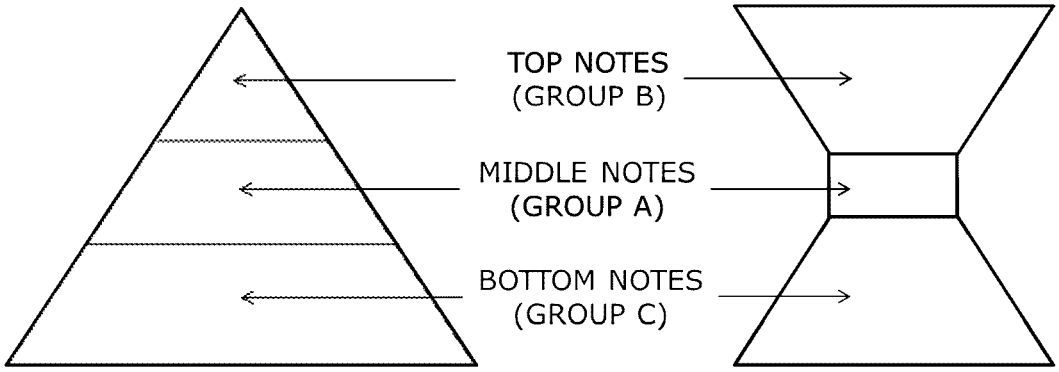
E1 F1
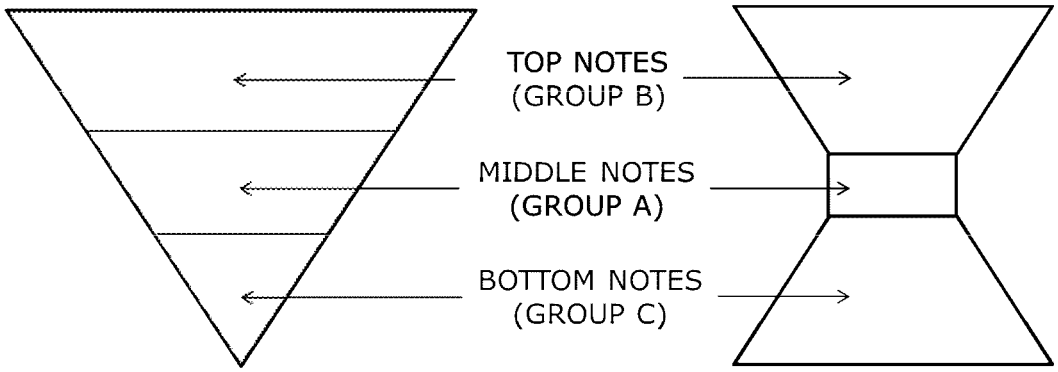
E2 F1
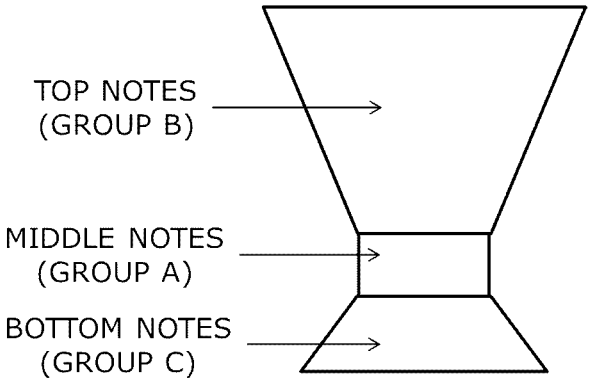
F2

FRAGRANCE COMPOSITIONS

CROSS REFERENCE TO RELATED APPLICATIONS

The present application is a national stage patent application of International Application No. PCT/EP2017/073062, filed 13 Sep. 2017, which claims priority from Great Britain Patent Application No. 1615581.4, filed on 14 Sep. 2016, both of which applications are hereby incorporated herein by reference in their entireties.

FIELD OF THE INVENTION

The present disclosure relates to perfumed products providing differentiated odour depending on assessment conditions. More particularly, the present disclosure relates to perfumed products providing odour that are significantly different, while still having the same intensity, depending on whether the odour is assessed initially under wet conditions or after a certain time under dry conditions.

BACKGROUND OF THE INVENTION

One sought after benefit of perfumed products is the generation of surprising olfactive effects during use.

These surprising olfactive effects may arise as a result of the dissolution of solid product, such as powder detergent, into water and the concomitant release of selected odourants, providing the user with a nice olfactive experience during application of the product, and providing the reassurance of an olfactive cue related to the product's efficacy.

Patent Application WO 99/65458 A1 discloses water-soluble, modified starch-based microcapsules comprising at least 10% by weight of fragrance ingredients having a boiling point at normal pressure of 275° C. or lower, a calculated C Log P of at least 2.0 and an odour detection threshold (ODT) of less than or equal to 50 ppb and at least 30% by weight of fragrance ingredients having a boiling point at normal pressure of greater than 275° C., a C Log P of at least 4.0 and an ODT of less than or equal to 50 ppb. These microcapsules are intended to release high impact odourant in contact with water.

WO 1997034988 A1 discloses a glass and hard surface cleaning compositions. The compositions comprise efficient blooming perfumes, characterized in such that from 0.001% to 3% of a blooming perfume composition comprising at least 50% of blooming perfume ingredients selected from the group consisting of: ingredients having a boiling point of less than 260° C. and a C log P of at least 3 (and wherein said perfume composition comprises at least 5 different blooming perfume ingredients). However, this disclosure does not provide any guidance as to what is a "blooming perfume" in terms of sensory benefits.

U.S. Pat. No. 5,508,259 A discloses perfume compositions that comprise an encapsulated perfume and a non-encapsulated perfume, wherein the encapsulated perfume has an odour character that is different from that of the non-encapsulated perfume, so that a distinct odour signal is produced when the microcapsules are dissolved in water. Here again the olfactory benefit is generated under the effect of an external action and requires the use of microcapsules.

The use of microcapsules to release high performance odourants at different moments of an application is well known. The release of the odour benefit is generally induced by mechanical rupture of frangible core-shell microcapsules or slow diffusion through slightly permeable capsule walls.

However, the use of microcapsules is not always desired. For instance, microcapsules may be visible in water-clear products and impart an unacceptable appearance to the product. Microcapsules may also be visible on hard, smooth surfaces treated with products that would include such capsules. This is especially the case of hard surface or glass cleaners.

US 20030166497 A1 discloses a process for preparing or selecting compositions having a fragrance burst of at least 20% relative to a product before dilution (as well as enhanced deposition). The composition is selected such that perfume and surfactant in said composition yields a calculated "Perfume Burst Index" (PBI) value of less than 3, wherein the value of the PBI is calculated by using an algorithm. It is anticipated that, in general, the burst is achieved by diluting a surfactant system until the critical micelle concentration is reached and the surfactant micelles dissociate.

However, when a substrate treated with a perfumed product starts to dry the perception of perfume usually decreases, which is due to the combination of decreasing amount of odourant molecules present on the substrate on the one hand, and perfume linearity (i.e. the maintenance of a constant perfume character through the evaporation process) on the other. While linearity is a basic of the established art of perfumery, it contributes to the onset of consumer fatigue and habituation, leading to a loss of the sensory perception mentioned herein above. So far no solution exists to this issue that does not involve the use of microcapsules.

There is therefore a need for fragrance compositions, and more particularly microcapsule-free fragrance compositions that exhibit perceptibly different odour characteristics depending on assessment conditions. In particular, there is a need for fragrance compositions, and more particularly microcapsule-free fragrance compositions, for use in perfumed products that provide perceptibly different odour characteristics at different stages of use or application of the perfumed products, from the wet stage, e.g. from its point of purchase and its application onto a substrate to be treated, through to the dry stage, when it has been deposited and dried down on the substrate.

SUMMARY OF THE INVENTION

In addressing the deficiencies in the prior art the applicant surprisingly found that it was possible to construct fragrance compositions that exhibit markedly different odour profiles depending upon whether they are assessed under wet stage conditions or under dry stage conditions, said fragrances being constructed by selecting fragrance ingredients grouped on the basis of their equilibrium headspace concentration, such that the composition contains three groups of ingredients consisting of a first group containing only relatively highly volatile ingredients; a second group containing only relatively low volatile ingredients, and a third group containing only ingredients of intermediate equilibrium headspace concentration, such that the third group of ingredients is present in significantly lower quantities than both the first group and the second group of ingredients.

Furthermore, the applicant found that the different odour characteristics were particularly pronounced when a significant proportion of the first group ingredients possessed odour characteristics that were mutually opposing (as that term is defined herein below) to a significant proportion of the second group of ingredients.

Accordingly, the invention provides in a first aspect a fragrance composition comprising:

a) less than 20% by weight of the fragrance composition consisting of perfumery ingredients that have an equilibrium headspace concentration between 151 and 900 microgram/l at 25° C. (hereinafter "Group A" ingredients); and b) at least 35% by weight of the fragrance composition consisting of perfumery ingredients that have an equilibrium headspace concentration higher than 900 microgram/l at 25° C. (hereinafter "Group B" ingredients); and c) at least 25, more particularly at least 30, still more particularly at least 40% by weight of the fragrance composition consisting of perfumery ingredients that have an equilibrium headspace concentration lower than or equal to 150 microgram/l at 25° C. (hereinafter "Group C" ingredients).

The perfumery ingredients set forth in a), b) and c) above may represent at least 90 wt %, at least 91 wt %, at least 92 wt %, at least 93 wt %, at least 94 wt %, at least 95 wt %, at least 96 wt %, at least 97 wt %, at least 98 wt %, at least 99 wt %, or 100 wt % of the perfumery ingredients contained in the fragrance composition.

In an aspect of the invention there is provided a fragrance composition as defined herein wherein more than 15% by weight of perfumery ingredients are Group B ingredients that are perceivable during the wet stage of application; and wherein more than 15% by weight of the perfumery ingredients are Group C ingredients that are perceivable during the dry stage of application.

In an aspect of the invention there is provided a fragrance composition as defined herein, wherein the more than 15% by weight of Group B ingredients that are perceivable during the wet stage of application; and the more than 15% by weight of the Group C ingredients that are perceivable during the dry stage of application have mutually opposed odour characteristics.

In an aspect of the invention there is provided a fragrance composition as defined herein wherein the fragrance composition is not encapsulated.

In an aspect of the invention there is provided a consumer product comprising a fragrance composition as defined herein.

In an aspect of the invention there is provided a method of applying a perfumed product to a substrate to provide two perceptibly different odour impressions to the substrate, wherein a first odour impression is perceived during application of the perfumed product to the substrate and a second odour impression is perceived after the perfumed product has dried on the substrate, said method comprising the step of applying to the substrate a perfumed product containing a fragrance composition as defined herein.

In an aspect of the invention, there is provided a method of reducing, resisting or eliminating consumer perfume habituation to a perfumed product, said method comprising the step of applying a consumer product containing a fragrance composition as herein defined to a substrate in need of treatment.

These and other features, aspects and advantages of specific embodiments will become evident to those skilled in the art from a reading of the present disclosure.

BRIEF DESCRIPTION OF THE DRAWINGS

While the specification concludes with claims which particularly point out and distinctly claim the present invention, it is believed that the present invention will be better understood from the following description of preferred embodiments, taken in conjunction with the accompanying drawings, in which like reference numerals identify identical elements and wherein: FIG. 1 shows show two classical constructions E1 and E2 of perfumes according to the art, wherein the level of Group A ingredients (also referred to hereafter as "middle notes") is between the levels of Group B ingredients (also referred to hereafter as "top notes") and Group C ingredients (also referred to hereafter as "bottom notes"); and two perfume constructions F1 and F2 according to the present disclosure, wherein the level of Group A ingredients is lower than the levels of Group B and Group C ingredients. In FIG. 1, the surface area of the geometric shape corresponding to the different Groups is proportional to the total percentage by weight of the ingredients included in each Group.

DETAILED DESCRIPTION OF THE INVENTION

The standard equilibrium headspace concentration (HS), expressed in microgram/liter (μg/L), refers to the concentration of the ingredient in equilibrium with the condensed form—that is solid or liquid form—of this ingredient at a temperature of 25° C. and under a pressure of 1 atmosphere. It can be measured by using any of the known quantitative headspace analysis techniques in the art. A suitable method is described in Mueller and Lamparsky in Perfumes: Art, Science and Technology, Chapter 6 "The Measurement of Odors" at pages 176-179 (Elsevier 1991).

HS may be measured as follows: 500 mg of a test perfumery ingredient is added to a headspace container which is then sealed. The container is then incubated at constant 25° C. until the compound reaches equilibrium between the gas and the liquid phase. A defined volume of this saturated headspace (usually 0.5-1.0 liter) is trapped on a micro filter using poly(4-ethyl styrene-co-divinyl benzene) porous material, for example Porapak® Q from Supelco, as sorbent. After extraction with an appropriate solvent (usually 30-100 microliters methyl tertiary butyl ether), an aliquot of the extract is analyzed by GC. The concentration in the original headspace can be calculated (in terms of μg/L) from the headspace volume sucked through the micro filter and the aliquot of the filtered extract injected into the gas chromatograph. The final headspace concentration value of given test perfumery ingredient is obtained as the mean value of three independent measurements each. Further information of the technique hereinabove described may be found in the article of Etzweiler, F.; Senn E. and Neuner-Jehle N., Ber. Bunsen-Ges. Phys. Chem. 1984, 88, 578-583, which is hereby incorporated by reference.

Reference herein the percentage (%) by weight of a perfume ingredient in a fragrance composition is reference to the concentration of a perfume ingredient or perfume ingredients based on the total amount of perfume ingredients contained in said composition. If a fragrance composition contains other non-perfumery or technical ingredients, such as solvents, solubilizers, stabilizers, and the like, then the amount of these ingredients present is not to be taken into account when determining the percentage (%) by weight of perfume ingredients. Solvents that are not taken into account in the calculation of the percentage (%) by weight include DIPROPYLENE GLYCOL (3-(3-hydroxypropoxy)propan-1-ol); PROPYLENE GLYCOL (propane-1,2-diol); TRIETHYL CITRATE (triethyl 2-hydroxypropane-1,2,3-tricarboxylate); ISOPROPYL MYRISTATE (propan-2-yl tetradecanoate); DIMETHYL ISOSORBIDE (3,6-dimethoxy-2,3,3a,5,6,6a-hexahydrofuro[3,2-b]furan); WATER; ETHANOL; ISOPROPANOL (ethan-1-ol); DIETHYL PHTHALATE (diethyl benzene-1,2-dicarboxylate); DIPROPYLENE GLYCOL DIMETHYL ETHER (1-methoxy-3-(3-methoxypropoxy)prop ane); DIPROPYLENE GLYCOL METHYL ETHER (3-(3-methoxypropoxy) propan-1-ol); DIPROPYLENE GLYCOL METHYL ETHER ACETATE (1-((1-methoxypropan-2-yl)oxy)propan-2-yl acetate); DIPROPYLENE GLYCOL n-BUTYL ETHER (1-((1-butoxypropan-2-yl)oxy)propan-2-ol); PROPYLENE GLYCOL METHYL ETHER (1-methoxypropan-2-ol); PROPYLENE GLYCOL n-BUTYL ETHER (1-butoxypropan-2-ol); PROPYLENE GLYCOL n-PROPYL ETHER (1-propoxypropan-2-ol); TRIPROPYLENE GLYCOL METHYL ETHER (1-((1-((1-methoxypropan-2-yl) oxy)propan-2-yl)oxy)propan-2-ol); DIPROPYLENE GLYCOL DIMETHYL ETHER (2-methoxy-1-((1-methoxypropan-2-yl)oxy)propane); ISOPARAFFINIC HYDROCARBON OILS, such as C8-C9 Isoparaffin, C8-C12 Isoparaffin, C10-11 Isoparaffin, C10-12 Isoparaffin, C12-C14 Isoparaffin, C11-C16 Isoparaffin, C12-C20 Isoparaffin, and the like; DIMETHYL GLUTARATE; DIMETHYL SUCCINATE; DIMETHYL ADIPATE; ISOPROPYLIDENE GLYCEROL (2,2-dimethyl-1,3-dioxolane-4-methanol); and the like.

Stabilizers that are not taken into account in the calculation of percentage (%) by weight include BUTYL HYDROXY TOLUENE (2,6-ditert-butyl-4-methylphenol); and the like.

Solubilizers that are not taken into account in the calculation of the percentage (%) by weight include surfactants, such as polyethyleneglycol-40 hydrogenated castor oil; alkyldiphenyloxide disulfonate; alkylamide oxide, such as N,N-dimethyldodecan-1-amine oxide; polysorbates, such as 2-[2-[3,4-bis(2-hydroxyethoxy)oxolan-2-yl]-2-(2-hydroxyethoxy)-ethoxy]ethyl dodecanoate; alkyl alcohol ethoxylates, and the like.

A fragrance composition constructed in the manner defined herein in accordance with the invention is, to the applicant's best knowledge, unlike conventional fragrance composition construction in the prior art. In FIG. 1, the schemes E1 and E2 depict the conventional manner in which fragrance compositions are constructed, wherein the high, medium and low equilibrium headspace concentration ingredients are present at increasing or decreasing levels in the composition.

Conversely, the scheme F1 and F2 depict two possible constructions of fragrance compositions of the present invention: the former can be visualized as a hour glass construction wherein there is an over-expression of top and bottom notes (respectively Group B and Group C ingredients), and the latter can be visualized as a funnel wherein there is an over-expression of top notes (Group B ingredients), compared to Group A ingredients and to Group C ingredients, and an over expression of bottom notes (Group C ingredients), compared to Group A ingredients. In both constructions there is a relative paucity of middle notes (respectively Group A ingredients), compared to both Group B ingredients and Group C ingredients.

Nevertheless, the applicant surprisingly found that, applying such construction, it was possible to create balanced and hedonically pleasant perfume compositions, exhibiting in addition to this hedonic pleasantness significantly different odour character depending on assessment conditions and described herein above.

In particular, the fragrance compositions of the present invention can provide odours to perfumed products that are perceptibly different, while still having the same intensity, depending on whether the odour is assessed initially under wet conditions or under dry conditions. These different perceptions reduce significantly the habituation of the consumer to the perfume during the time this perfume can be perceived, for example during one hour and more.

In the context of the present disclosure, the term "perceptibly different" as it relates to the odour characteristics of fragrance compositions assessed under different conditions, means that trained panellists are capable of differentiating unambiguously the odour of a given fragrance composition under a first condition, for example during or after dilution of a perfumed product containing said fragrance composition in water, or on a substrate wetted with said product, from that of the same perfumed product, but under a second condition, for example after said product has dried on the substrate. Under such conditions, the difference is deemed to be consumer noticeable, that is, a majority of consumers will perceive the change of odour from said first condition to said second condition.

Methods to define odours exist and can be used in the context of the present invention. For example, an odour may be defined by using pre-defined semantic attributes, such as "CITRUS/ALDEHYDIC", as in the case of a lemon odour, a lime odour, an orange odour or a grapefruit odour and the like; "FRUITY", as in the case of an apple odour, a peach odour, a berry odour, and the like; "GREEN", as in the case of a freshly cut grass odour, a leaf odour, and the like; "AROMATIC/HERBAL", as in the case of a resinous odour, a turpentine odour, a straw odour, and the like; "FLORAL", as in the case of a rose odour, a lily of the valley odour, and the like; "WOODY", as in the case of a sandal wood odour, a cedar odour, a patchouli odour, and the like; "MUSKY", as in the case of a musk odour; or "SWEET", as in the case of a caramel odour, a vanilla odour, a cinnamon odour, and the like. Other semantic attributes may be defined if needed, depending on the desired accuracy of the odour definition. An odour may also be defined as a combination of semantic attributes. Numerous examples of alternative semantic attributes suitable for odour definitions may be found, for example, in S. Arctander, "Perfume and Flavor Chemicals", Allured Pub. Corp. Wheaton, 1969 and on web sites, such as www.thegoodscentscompany.com.

A suitable way to assess the different odour characteristics is to use a test cabin with controlled environmental conditions, such as temperature, relative humidity, and switchable ventilation. The initial assessment (i.e. under wet conditions), is also referred to as bloom assessment, and is performed initially after applying a perfumed product on the floor of the cabin, for example 3 or 5 minutes after application, while the assessment after drying is performed after about 1 hour after application. Example 3 describes a typical way of performing such assessment tests.

In the construction of fragrance compositions in accordance with the present invention and as depicted in FIG. 1, Scheme F1 and F2, applicant found it was possible to enhance the differences between odour characteristics at wet and dry stages by selecting Group B and Group C perfumery ingredients according to mutually opposing odour directions. In particular, the applicant has found that some pairs of odour directions were more opposing each other, in terms of odour perception, than other pairs and were thereby more suitable for generating significantly different odours under different assessment conditions.

Accordingly, in an embodiment of the present invention the fragrance composition contains Group B ingredients that are perceivable during the wet stage of application; and Group C perfume ingredients that are perceivable during the dry stage; wherein said Group B ingredients and Group C ingredients are selected from mutually opposing pairs of ingredients.

In a more particular embodiment of the present invention the fragrance composition contains at more than 15% by weight of Group B ingredients that are perceivable during the wet stage of application; and more than 15% by weight of Group C perfume ingredients that are perceivable during the dry stage; wherein said Group B ingredients and Group C ingredients are selected from mutually opposing pairs of ingredients.

Mutually opposing pairs of odourant classes are shown in Table 1, below. The ingredient between parentheses is shown as an example of a specific ingredient known and understood by skilled perfumers to possess the associated odour characteristic. GROUP B ingredients, which are characteristically so-called "blooming" ingredients, which are perceivable at the wet stage, are shown in the left-hand column. GROUP C ingredients, which are characteristically long-lasting ingredients, which are perceivable during the dry stage, are shown in the right-hand column. Pairs of mutually opposing odourant classes are aligned in rows.

TABLE 1

Odour directions opposing each other particularly strongly when compared on wet substrate and on dry substrate.

| Immediate perception (wet substrate) | Long lasting perception (dry substrate) |
|---|---|
| FRUITY<br>(AMYL ACETATE, ALLYL HEPTANOATE, MANZANATE, OXANE, HEXYL ACETATE, BENZALDEHYDE, MELONAL)<br>*CITRUS*/ALDEHYDIC<br>(ALDEHYDE C 8 OCTYLIC, LIMONENE)<br>GREEN<br>(TRICYCLAL, CIS-3-HEXENOL)<br>HERBAL/AROMATIC<br>(EUCALYPTOL, CAMPHOR, ROSE OXIDE, BORNYL ACETATE, PINENE ALPHA) | AMBER/WOODY<br>(AMBROFIX, AMBROCENIDE, EVERNYL, SANDALORE, CEDRENOL, PATCHOULI)<br>FLORAL<br>(ISORALDEINES, SALICYLATES, CYCLAMEN ALDEHYDE, METHYL ANTHRANILATE, CITRONELLOL)<br>SWEET<br>(VANILLIN, COUMARIN, ETHYL MALTOL, HELIOTROPINE)<br>MUSK<br>(GALAXOLIDE, AMBRETTOLIDE)<br>FRUITY<br>(PEACH, PRUNOLIDE, DAMASCONES, RASPBERRY KETONE, STRAWBERRY) |
| FLORAL<br>(METHYL SALICYLATE, ACETOPHENONE, BENZYL ACETATE, LINALOOL) | AMBER/WOODY<br>(AMBROFIX, AMBROCENIDE, EVERNYL, SANDALORE, CEDRENOL, PATCHOULI)<br>SWEET<br>(VANILLIN, COUMARIN, ETHYL MALTOL, HELIOTROPINE)<br>MUSK<br>(GALAXOLIDE, AMBRETTOLIDE)<br>FRUITY<br>(PEACH, PRUNOLIDE, DAMASCONES, RASPBERRY KETONE, STRAWBERRY) |

In one embodiment of the present invention, the Group B Ingredients that possess a FRUITY odour may be selected from the group consisting of FRUITY ingredients having equilibrium headspace concentration from 901 μg/l to 5000 μg/l, such as allyl heptanoate (for example ALLYL OENANTHATE), (Z)-hex-3-en-1-yl methyl carbonate (for example LIFFAROME), pentyl butanoate (for example AMYL BUTYRATE), 2,6-dimethylhept-5-enal (for example MELONAL); FRUITY ingredients having equilibrium headspace concentration from 5001 μg/l to 10000 μg/l, such as 3-methylbutyl butanoate (for example ISOAMYL BUTYRATE), benzaldehyde, (4S)-4,7,7-trimethyl-6-thiabicyclo[3.2.1]octane (for example CORPS PAMPLEMOUSSE), hexyl acetate (for example ACETATE C 6 HEXYLIC), (Z)-hex-3-en-1-yl acetate (for example HEXENYL-3-CIS ACETATE), 4-methylpent-4-en-2-yl 2-methylpropanoate (for example ISOPENTYRATE); FRUITY ingredients having equilibrium headspace concentration from 10001 μg/l to 20000 μg/l, such as 2-methyl-4-propyl-1,3-oxathiane (for example OXANE), 3-methylbut-2-en-1-yl acetate (for example PRENYL ACETATE), 6-methylheptan-3-one (for example ETHYL ISOAMYL KETONE), ethyl 2-methylpentanoate (for example MANZANATE); and FRUITY ingredients having equilibrium headspace concentration higher than 20000 μg/l, such as heptan-2-one (for example METHYL AMYL KETONE), 3-methylbutyl acetate (for example ISOAMYL ACETATE), ethyl 2-methylbutanoate (for example ETHYL METHYL-2-BUTYRATE), and ethyl butanoate (for example ETHYL BUTYRATE); and mixtures thereof.

In another embodiment of the present invention, the Group B ingredients that possess a CITRUS/ALDEHYDIC odour may be selected from the group consisting of CITRUS/ALDEHYDIC ingredients having equilibrium headspace concentration from 901 μg/l to 5000 μg/l, such as decanal (for example ALDEHYDE C 10 DECYLIC), (E)-dec-4-enal (for example DECENAL-4-TRANS), 3,7-dimethyloct-6-enal (for example CITRONELLAL), 1-phenylethanethiol (for example ANJERUK), 6,6-dimethoxy-2,5,5-trimethylhex-2-ene (for example METHYL PAMPLEMOUSSE), nonanal (for example ALDEHYDE C 9 NONYLIC), 4,7-dimethyloct-6-en-3-one (for example DIMETHYL OCTENONE), octanal (for example ALDEHYDE C 8 OCTYLIC); CITRUS/ALDEHYDIC ingredients having equilibrium headspace concentration from 5001 μg/l to 10000 μg/l, such as 3,5,5-trimethylhexanal (for example ALDEHYDE C 9 ISONONYLIC); CITRUS/ALDEHYDIC ingredients having equilibrium headspace concentration higher than 10001 μg/l, such as 1-methyl-4-(prop-1-en-2-yl)cyclohex-1-ene (for example DIPENTENE, LIMONENE), 1-methyl-4-(propan-2-ylidene)cyclohex-1-ene (for example TERPINOLENE), heptanal (for example ALDEHYDE C 7 HEPTYLIC); and mixtures thereof.

In another embodiment of the present invention, the Group B ingredients that possess a GREEN odour may be selected from the group consisting of GREEN ingredients having equilibrium headspace concentration from 901 μg/l to 5000 μg/l, such as (3E,5Z)-undeca-1,3,5-triene (for example UNDECATRIENE), (2E,6Z)-nona-2,6-dienal (for example NONADIENAL); 2,4-dimethylcyclohex-3-enecarbaldehyde (for example TRICYCLAL), 4-vinylcyclohex-1-enecarbaldehyde (for example SHISOLIA), 2,4-dimethylcyclohex-3-enecarbaldehyde (for example CYCLAL C), 4-methyl-2-(2-methylprop-1-en-1-yptetrahydro-2H-pyran (for example ROSE OXIDE CO); GREEN ingredients having equilibrium headspace concentration higher than 5001 μg/l, such as (Z)-hex-3-en-1-ol (for example HEXENOL-3-CIS), 7-methyl-3-methyleneocta-1,6-diene (for example MYRCENE), hexan-1-ol (for example ALDEHYDE C 6 HEXYLIC); and mixtures thereof.

In another embodiment of the present invention, the Group B ingredients that possess a HERBAL/AROMATIC odour may be selected from the group consisting of HERBAL/AROMATIC ingredients having equilibrium headspace concentration from 901 μg/l to 5000 μg/l, such as 3,7-dimethylocta-1,6-dien-3-yl acetate (for example LINALYL ACETATE), (2S,4S)-1,7,7-trimethylbicyclo[2.2.1]heptan-2-yl acetate (for example BORNYL ACETATE), 2-(s ec-butyl)cyclohexanone (for example FRE S KOMENTHE), (1S,2R,4R)-1,3,3-trimethylbicyclo[2.2.1]heptan-2-ol (for example FENCHYL ALCOHOL), 2-isopropyl-5-methylcyclohexanone (for example ISOMENTHONE DL), (2S)-1,3,3-trimethylbicyclo[2.2.1]heptan-2-yl acetate (for example FENCHYL ACETATE), 2,6-dimethyloct-7-en-2-ol (for example DIMYRCETOL), (1S,4S)-1,7,7-trimethylbicyclo[2.2.1]heptan-2-one (for example CAMPHOR), 2-isopropyl-5-methylcyclohexanone (for example MENTHONE); HERBAL/AROMATIC ingredients having equilibrium headspace concentration from 5001 μg/l to 10000 μg/l, such as 1-methyl-4-propan-2-ylcyclohexa-1,4-diene (for example TERPINENE GAMMA), 1-methyl-4-propan-2-ylbenzene (for example CYMENE PARA); HERBAL/AROMATIC ingredients having equilibrium headspace concentration higher than 10000 μg/l, such as (1s,4s)-1,3,3-trimethyl-2-oxabicyclo[2.2.2]octane (for example EUCALYPTOL), 2,2,6-trimethyl-6-vinyltetrahydro-2H-pyran (for example LIMETOL), 6,6-dimethyl-2-methylenebicyclo[3.1.1]heptane (for example PINENE BETA), 2,6,6-trimethylbicyclo[3.1.1]hept-2-ene (for example PINENE ALPHA);

In another embodiment of the present invention, the Group B ingredients that possess a FLORAL odour may be selected from the group consisting of FLORAL ingredients having equilibrium headspace concentration from 901 μg/l to 1500 μg/l, such as benzyl acetate (for example BENZYL ACETATE); methyl 2-hydroxybenzoate (for example METHYL SALICYLATE), 3,7-dimethyloctan-3-ol (for example TETRAHYDRO LINALOOL), (Z)-3,4,5,6,6-pentamethylhept-3-en-2-one (for example KOAVONE), 2,6-dimethyloct-7-en-2-ol (for example DIHYDRO MYRCENOL), 3,7-dimethylocta-1,6-dien-3-ol (for example LINALOOL), 2-(2-hydroxypropan-2-yl)-5-methylcyclohexanol (for example GERANODYLE); FLORAL ingredients having equilibrium headspace concentration from 1501 μg/l to 5000 μg/l, such as 1-phenylethanone (for example ACETOPHENONE), 2,6-dimethylheptan-2-ol (for example DIMETOL), methyl benzoate (for example METHYL BENZOATE); FLORAL ingredients having equilibrium headspace concentration higher than 5000 μg/l, such as 1-methoxy-4-methylbenzene (for example CRESYL METHYL ETHER PARA); and mixtures thereof.

As stated hereinabove, it is preferred that the level of Group B ingredients that are mutually opposing Group C ingredients should be higher than 15% by weight, and more particularly higher than 20% by weight based on the weight of the fragrance composition (excluding any the technical ingredients that may be present in the fragrance composition, such as solvents, solubilizers, stabilizers, and the like).

Similarly, and as also stated above, the level of Group C ingredients that are mutually opposing Group B ingredients in a fragrance composition is preferably greater than 15% by weight, more particularly greater than 20% by weight of the fragrance composition (excluding any the technical ingredients that may be present in the fragrance composition, such as solvents, solubilizers, stabilizers, and the like.

GROUP B ingredients may also comprise ingredients having other odour selected from the group consisting of ingredients having equilibrium headspace concentration from 901 μg/l to 2000 μg/l, such as 2-phenyl-ethanal (for example PHENYL ACETALDEHYDE), propyl (2S)-2-[(2-methyl-2-butanyl)oxy]propanoate (for example SCLAREOLATE), 5-methyl-2-(prop-1-en-2-yl)cyclohexanol (for example ISOPULEGOL); ethyl benzoate; ingredients having equilibrium headspace concentration from 2001 μg/l to 10000 μg/l, such as 2-methyl-5-propan-2-ylcyclohexa-1,3-diene (for example PHELLANDRENE), octan-2-one (for example METHYL HEXYL KETONE), 2-ethyl-4-methyl-1,3-thiazole (for example METHYL ISOPROPYL THIAZOL), octan-3-one (for example ETHYL AMYL KETONE); ingredients having equilibrium headspace concentration higher than 10000 μg/l, such as ethyl acetate; and mixtures thereof.

In another embodiment of the present invention, the Group C ingredients that possess a AMBERY/WOODY odour may be selected from the group consisting of AMBERY/WOODY ingredients having equilibrium headspace concentration from about 0.1 μg/l to about 10 μg/l, such as methyl 2,4-dihydroxy-3,6-dimethylbenzoate (for example EVERNYL), 3,8,8,11a-tetramethyldodecahydro-1H-3,5a-epoxynaphtho[2,1-c]oxepine (for example AMBERKETAL), 3-((1R,2S,4R,6R)-5,5,6-trimethylbicyclo[2.2.1]heptan-2-yl)cyclohexanol (for example SANDELA CONCENTRATED), 2-(2-(3,3,5-trimethylcyclohexyl)acetyl)cyclopentanone (for example DIONE), (4aR,5R,7aS,9R)-Octahydro-2,2,5,8,8,9a-hexamethyl-4H-4a,9-methanoazuleno[5,6-d]-1,3-dioxole (for example AMBROCENIDE), 5-(sec-butyl)-2-(2,4-dimethylcyclohex-3-en-1-yl)-5-methyl-1,3-dioxane (for example KARANAL), 2,4-dimethyl-2-(5,5,8,8-tetramethyl-5,6,7,8-tetrahydronaphthalen-2-yl)-1,3-dioxolane (for example OKOUMAL), (1-methyl-2-((1,2,2-trimethylbicyclo[3.1.0]hexan-3-yl)methyl)cyclopropyl)methanol (for example JAVANOL), ((1S,8aR)-1,4,4-trimethyl-2,3,3a,4,5,8-hexahydro-1H-5,8a-methanoazulen-6-yl)methanol (for example CEDRENOL), 1-((1S,8aS)-1,4,4,6-tetramethyl-2,3,3a,4,5,8-hexahydro-1H-5,8a-methanoazulen-7-yl)ethanone (for example METHYL CEDRYL KETONE), 1-((1S,8aS)-1,4,4,6-tetramethyl-2,3,3a,4,5,8-hexahydro-1H-5,8a-methanoazulen-7-yl)ethanone (for example VERTOFIX COEUR), 1-(2,2,6-trimethylcyclohexyl)hexan-3-ol (for example TIMBEROL), (7,7,8,8-tetramethyloctahydro-2,3b-methanocyclopenta[1,3]cyclopropa[1,2]benzen-4-yl)methyl acetate (for example AMBORYL ACETATE), (E)-2-ethyl-4-(2,2,3-trimethylcyclopent-3-en-1-yl)but-2-en-1-ol (for example RADJANOL), (1S,6R,8aR)-1,4,4,6-tetramethyloctahydro-1H-5,8a-methanoazulen-6-yl acetate (for example CEDRYL ACETATE CRYSTALS), 3a-ethyl-6,6,9a-trimethyldodecahydronaphtho[1,2-c]furan (for example GRISALVA); AMBERY/WOODY ingredients having equilibrium headspace concentration from about 11 μg/l to about 50 μg/l, such as 2-(3,8-dimethyl-1,2,3,4,5,6,7,8-octahydroazulen-5-yl) propan-2-yl acetate (for example GUAIYL ACETATE), 3-methoxy-5-methylphenol (for example ORCINYL 3), (1-methyl-2-(((1R,3R)-2,2,3-trimethylcyclopentyl)methyl) cyclopropyl)methanol (for example PASHMINOL), (E)-2-methyl-4-(2,2,3-trimethyl-1-cyclopent-3-enyl)but-2-en-1-ol (for example SANTACORE), 3-methyl-5-(2,2,3-trimethyl-cyclopent-3-en-1-yl)pentan-2-ol (for example SANDALORE), (4Z,8Z)-1,5,9-trimethyl-13-oxabicyclo[10.1.0]trideca-4,8-diene (for example CEDROXYDE), (ethoxymethoxy)cyclododecane (for example BOISAMBRENE FORTE), 4,8a,9,9-tetramethyldecahydro-1,6-methanonaphthalen-1-ol (for example PATCHOULI ALCOHOL), (E)-2-methyl-4-(2,2,3-trimethyl-1-cyclopent-3-enyl) but-2-en-1-ol (for example BRAHMANOL F), 1-(2,3,8,8-tetramethyl-1,2,3,4,5,6,7,8-octahydronaphthalen-2-yl) ethanone (for example ISOCYCLEMONE E), 1-(2,3,8,8-tetramethyl-1,2,3,4,5,6,7,8-octahydronaphthalen-2-yl) ethanone (for example ISO E SUPER), 1-(1,2,8,8-tetramethyl-1,2,3,4,5,6,7,8-octahydronaphthalen-2-yl) ethanone (for example GEORGYWOOD), N-ethyl-N-(m-tolyl)propionamide (for example AGARBOIS), 2,4a,5,8a-tetramethyl-1,2,3,4,4a,7,8,8a-octahydronaphthalen-1-yl formate (for example OXYOCTALINE FORMATE), (E)-3-methyl-5-(2,2,3-trimethylcyclopent-3-en-1-yl)pent-4-en-2-ol (for example EBANOL), (E)-3,3-dimethyl-5-(2,2,3-trimethyl-3-cyclopenten-1-yl)-4-penten-2-ol (for example POLYSANTOL), 1-((2-(tert-butyl)cyclohexyl)oxy)butan-2-ol (for example AMBER CORE), 7-methoxy-3,7-dimethyl-octan-2-ol (for example OSYROL); AMBERY/WOODY ingredients having equilibrium headspace concentration from about 51 g/l to about 100 μg/l, such as (1R,2S,4R)-2'-isopropyl-1,7,7-trimethylspiro[bicyclo[2.2.1]heptane-2,4'-[1,3]dioxane] (for example BELAMBRE), (1R,6S,8aS)-6-methoxy-1,4,4,6-tetramethyloctahydro-1H-5,8a-methanoazulene (for example CEDRYL METHYL ETHER), (Z)-1-(cyclooct-3-en-1-yl)propan-1-ol (for example FLORYMOSS), 2',2',3,7,7-pentamethylspiro[bicyclo[4.1.0]heptane-2,5'-[1,3]dioxane](for example SPIRAMBRENE), 4-(1-ethoxyvinyl)-3,3,5,5-tetramethylcyclohexanone (for example KEPHALIS); AMBERY/WOODY ingredients having equilibrium headspace concentration from about 100 μg/l to 150 μg/l, such as (1S,2R,5R)-2-ethoxy-2,6,6-trimethyl-9-methylenebicyclo[3.3.1]nonane (for example BOISIRIS), 2-(tert-pentyl)cyclohexyl acetate (for example CONIFERAN), 2-(sec-butyl)-1-methylcyclohexyl acetate (for example METAMBRATE), 4-(tert-butyl) cyclohexyl acetate (for example BUTYL CYCLOHEXYL ACETATE PARA), 2-(4-methylcyclohexyl)propan-2-yl acetate (for example MENTHANYL ACETATE), and mixtures thereof.

In another embodiment of the present invention, the Group C ingredients that possess a FLORAL odour may be selected from the group consisting of FLORAL ingredients having equilibrium headspace concentration from about 1 μg/l to about 10 μg/l, such as benzyl 2-hydroxybenzoate (for example BENZYL SALICYLATE), (4E)-9-hydroxy-5,9-dimethyl-4-decenal (for example MAHONIAL), 2-cyclohexylidene-2-phenylacetonitrile (for example PEONILE), 2-hexylcyclopent-2-enone (for example ISOJASMONE T), 1-(2-naphtalenyl)-ethanone (for example ORANGER CRYSTALS), 2,2,2-trichloro-1-phenylethyl acetate (for example ROSACETOL), 3-(benzo[d][1,3]dioxol-5-yl)-2-methylpropanal (for example TROPIONAL), hexyl 2-hydroxybenzoate (for example HEXYL SALICYLATE); FLORAL ingredients having equilibrium headspace concentration from about 11 μg/l to about 50 μg/l, such as (4Z)-hept-4-en-2-yl 2-hydroxybenzoate (for example KARMAFLOR), 3-(4-isobutyl-2-methylphenyl)propanal (for example NYMPHEAL), 3-methyl-5-phenylpentan-1-ol (for example MEFROSOL), (Z)-6-(pent-2-en-1-yl)tetrahydro-2H-pyran-2-one (for example JASMIN LACTONE DELTA), 3-(4-(tert-butyl)phenyl)-2-methylpropanal (for example LILIAL), (E)-3-phenylprop-2-en-1-ol (for example CINNAMIC ALCOHOL), 2-methoxynaphthalene (for example YARA YARA), (4-methoxyphenyl)methanol (for example ANISYL ALCOHOL), 2-ethoxynaphthalene (for example NEROLINE CRYSTALS), 2,2-dimethyl-3-(m-tolyl)propan-1-ol (for example MAJANTOL), 7,9-dimethylspiro[5.5]undecan-3-one (for example DISPIRONE), 3-(4-(tert-butyl)phenyl)propanal (for example BOURGEONAL), (E)-4-((3aS,7aS)-hexahydro-1H-4,7-methanoinden-5(6H)-ylidene)butanal (for example DUPICAL), pentyl 2-hydroxybenzoate (for example AMYL SALICYLATE), (E)-4-(2,5,6,6-tetramethylcyclohex-2-en-1-yl)but-3-en-2-one (for example IRONE ALPHA); FLORAL ingredients having equilibrium headspace concentration from about 51 μg/l to about 100 μg/l, such as 3-(4-isopropylphenyl)-2-methylpropanal (for example CYCLAMEN ALDEHYDE), 4-(4-methylpent-3-en-1-yl)cyclohex-3-enecarbaldehyde (for example MYRALDENE), dec-9-en-1-ol (for example ROSALVA), (1-methyl-2-(5-methylhex-4-en-2-yl) cyclopropyl)methanol (for example ROSYFOLIA), 3-(3-isopropylphenyl)butanal (for example FLORHYDRAL), 3-phenylpropan-1-ol (for example PHENYL PROPYL ALCOHOL), 2-methyl-4-phenylbutan-2-ol (for example DIMETHYL PHENYL ETHYL CARBINOL), methyl 2-aminobenzoate (for example METHYL ANTHRANILATE), tetrahydro-4-methyl-2-(2-methylpropyl)-2H-pyran-4-ol (for example FLOROSA); FLORAL ingredients having equilibrium headspace concentration from about 101 g/l to 150 μg/l, such as 3-(4-ethylphenyl)-2,2-dimethylpropanal (for example FLORALOZONE), methyl 2-(methylamino)benzoate (for example DIMETHYL ANTHRANILATE), (E)-3,7-dimethylocta-2,6-dien-1-ol (for example GERANIOL), (E)-4-(2,6,6-trimethylcyclohex-1-en-1-yl) but-3-en-2-one (for example IONONE BETA), 3,7-dimethyloct-6-en-1-ol (for example CITRONELLOL), 4-(2,6,6-trimethylcyclohex-1-en-1-yl)butan-2-one (for example DIHYDRO IONONE BETA), (E)-3-methyl-4-(2,6,6-trimethylcyclohex-2-en-1-yl)but-3-en-2-one (for example ISORALDEINE 70), 4-cyclohexyl-2-methylbutan-2-ol (for example CORANOL), (Z)-3-methyl-2-(pent-2-en-1-yl)cyclopent-2-enone (for example JASMONE CIS); and mixtures thereof.

In another embodiment of the present invention, the Group C ingredients that possess a SWEET/SPICY odour may be selected from the group consisting of SWEET/SPICY ingredients having equilibrium headspace concentration from about 0.01 μg/l to about 10 μg/l, such as 3-phenylprop-2-enyl 3-phenylprop-2-enoate (for example CINNAMYL CINNAMATE), 4-formyl-2-methoxyphenyl isobutanoate (for example ISOBUTAVAN), 3-ethoxy-4-hydroxybenzaldehyde (for example ETHYL VANILLIN), 2H-chromen-2-one (for example COUMARIN), 3-hydroxy-2-methyl-4H-pyran-4-one (for example MALTOL), 2-ethyl- 3-hydroxy-4H-pyran-4-one (for example ETHYL MALTOL); SWEET/SPICY ingredients having equilibrium headspace concentration from about 11 μg/l to about 50 μg/l, such as (E)-2-methoxy-4-(prop-1-en-1-yl)phenol (for example ISOEUGENOL), 4-allyl-2-methoxyphenyl acetate (for example EUGENYL ACETATE), (E)-1,2-dimethoxy-4-(prop-1-en-1-yl)benzene (for example METHYL ISOEUGENOL), octahydro-2H-chromen-2-one (for example BICYCLO NONALACTONE), benzo[d][1,3]dioxole-5-carbaldehyde (for example HELIOTROPINE); SWEET/SPICY ingredients having equilibrium headspace concentration from about 51 μg/l to 150 μg/l, such as 2-methoxy-4-propylphenol (for example DIHYDRO EUGENOL), (E)-3-phenylprop-2-enenitrile (for example CINNAMALVA), 4-allyl-2-methoxyphenol (for example EUGENOL), (2E)-3-phenylprop-2-enal (for example CINNAMIC ALDEHYDE); and mixtures thereof.

In another embodiment of the present invention, the Group C ingredients that possess a MUSKY odour may be selected from the group consisting of MUSKY ingredients having equilibrium headspace concentration from about 1 μg/l to about 10 μg/l, such as (Z)-cycloheptadec-9-enone (for example CIVETTONE), 1,4-dioxacycloheptadecane-5,17-dione (for example ETHYLENE BRASSYLATE), 1,4-dioxacyclohexadecane-5,16-dione (for example MUSK C14), 4,6,6,7,8,8-hexamethyl-1,3,4,6,7,8-hexahydrocyclopenta[g]isochromene (for example GALAXOLIDE), (Z)-oxacycloheptadec-10-en-2-one (for example AMBRETTOLIDE), 2-(1-(3,3-dimethylcyclohexyl)ethoxy)-2-methylpropyl cyclopropanecarboxylate (for example SERENOLIDE), 1-oxacycloheptadecan-2-one (for example DIHYDRO AMBRETTOLIDE), (E)-oxacyclohexadec-12-en-2-one (for example HABANOLIDE), (Z)-cyclohexadec-5-enone (for example VELVIONE), cyclopentadecanone (for example MUSK CPD), (Z)-3-methylcyclopentadec-5-enone (for example MUSCENONE), oxacyclohexadecan-2-one (for example THIBETOLIDE), (Z)-3-methylcyclotetradec-5-enone (for example COSMONE), (E)-13-methyloxacyclopentadec-10-en-2-one (for example NIRVANOLIDE); MUSKY ingredients having equilibrium headspace concentration from about 11 μg/l to 100 μg/l, such as (E)-2-((3,5-dimethylhex-3-en-2-yl)oxy)-2-methylpropyl cyclopropanecarboxylate (for example SYLKOLIDE), 1a,3,3,4,6,6-hexamethyl-1a,2,3,4,5,6,7,7a-octahydronaphtho[2,3-b]oxirene (for example MOXALONE), MUSKY ingredients having equilibrium headspace concentration from about 101 μg/l to 150 μg/l, such as 1,1,2,3,3-pentamethyl-2,3,6,7-tetrahydro-1H-inden-4(5H)-one (for example CASHMERAN); and mixtures thereof.

In another embodiment of the present invention, the Group C ingredients that possess a FRUITY odour may be selected from the group consisting of FRUITY ingredients having equilibrium headspace concentration from about 0.01 μg/l to about 10 μg/l, such as 4-(4-hydroxyphenyl) butan-2-one (for example RASPBERRY KETONE), 6-heptyltetrahydro-2H-pyran-2-one (for example DODECALACTONE DELTA), 5-octyloxolan-2-one (for example DODECALACTONE GAMMA), 6-hexyltetrahydro-2H-pyran-2-one (for example UNDECALACTONE DELTA); FRUITY ingredients having equilibrium headspace concentration from about 11 μg/l to about 50 μg/l, such as 6-pentyltetrahydro-2H-pyran-2-one (for example DECALACTONE DELTA), 5-hexyloxolan-2-one (for example DECALACTONE GAMMA), ethyl methyl phenyl glycidate (for example STRAWBERRY), 4-methyl-5-pentyldihydrofuran-2(3H)-one (for example METHYL TUBERATE); FRUITY ingredients having equilibrium headspace concentration from about 51 μg/l to 150 μg/l, such as ethyl 6-acetoxyhexanoate (for example BERRYFLOR), 5-pentyldihydrofuran-2(3H)-one (for example PRUNOLIDE), 2-methyl-1-phenylpropan-2-yl butanoate (for example DIMETHYL BENZYL CARBINYL BUTYRATE), 6-propyltetrahydro-2H-pyran-2-one (for example OCTALACTONE DELTA), (E)-1-(2,6,6-trimethylcyclohex-1-en-1-yl) but-2-en-1-one (for example DAMASCONE BETA); (E)-1-(2,6,6-trimethylcyclohex-2-en-1-yl)but-2-en-1-one (for example DAMASCONE ALPHA); (E)-1-(2,6,6-trimethylcyclohex-3-en-1-yl)but-2-en-1-one (for example DAMASCONE DELTA); and mixtures thereof.

GROUP C ingredients may also comprise ingredients belonging to other odour directions such as ingredients having equilibrium headspace concentration from about 1 μg/l to about 10 μg/l, such as (2E,6Z)-3,7,11-trimethyldodeca-2,6,10-trien-1-ol (for example FARNESOL), 2-phenethyl 2-hydroxybenzoate (for example PHENYL ETHYL SALICYLATE CRYSTALS), (E)-2-benzylideneoctanal (for example ALPHA HEXYL CINNAMIC ALDEHYDE), diphenylmethanone (for example BENZOPHENONE), methyl 3-oxo-2-pentylcyclopentaneacetate (for example HEDIONE), (3E,6E)-2,4,4,7-tetramethylnona-6,8-dien-3-one oxime (for example LABIENOXIME), 3-(benzo[d][1,3]dioxol-5-yl)-2-methylpropanal (for example TROPIONAL); ingredients having equilibrium headspace concentration from about 11 μg/l to about 50 μg/l, such as (E)-tridec-2-enenitrile (for example TRIDECENE-2-NITRILE), 3-(4-methoxyphenyl)-2-methylpropanal (for example FENNALDEHYDE), (E)-6,10-dimethylundeca-5,9-dien-2-yl acetate (for example TANGERINOL), 6-butan-2-yl-quinoline (for example ISOBUTYL QUINOLINE), 2,6,10-trimethylundec-9-enal (for example ADOXAL), 7-methyl-2H-benzo[b][1,4]dioxepin-3(4H)-one (for example CALONE 1951); ingredients having equilibrium headspace concentration from about 51 μg/l to about 100 μg/l, such as dodecanenitrile (for example CLONAL), 4,4a,5,9b-tetrahydroindeno[1,2-d][1,3]dioxine (for example INDOFLOR), 2-cyclohexylhepta-1,6-dien-3-one (for example PHARAONE), decan-1-ol (for example ALCOHOL C 10 DECYLIC), 8-(sec-butyl)-5,6,7,8-tetrahydroquinoline (for example BIGARYL), methyl 3-phenylprop-2-enoate (for example METHYL CINNAMATE), (E)-undec-9-enenitrile (for example FLORIDILE); ingredients having equilibrium headspace concentration from about 101 μg/l to 150 μg/l, such as (E)-7,11-dimethyl-3-methylenedodeca-1,6,10-triene (for example FARNESENE), (3aR,6S,7aS)-3a,4,5,6,7,7a-hexahydro-1H-4,7-methanoinden-6-yl propionate (for example FLOROCYCLENE), 4-(tert-butyl) cyclohexanol (for example BUTYL CYCLOHEXANOL PARA), 1-(3,3-dimethylcyclohex-1-en-1-yl)pent-4-en-1-one (for example GALBANONE), dodecanal (for example ALDEHYDE C 12 LAURIC), 2-isopropyl-5-methylphenol (for example THYMOL CRYSTALS), (E)-3-phenylprop-2-en-1-ol (for example CINNAMIC ALCOHOL), allyl 3-cyclohexylpropionate (for example ALLYL CYCLOHEXYL PROPIONATE), diphenylmethane (for example DIPHENYL METHANE), (E)-4-methyldec-3-en-5-ol (for example UNDECAVERTOL); and mixtures thereof.

GROUP A ingredients may include perfumery ingredients having other odour selected from the group consisting of ingredients having equilibrium headspace concentration from 151 g/l to about 200 μg/l, such as methyl non-2-ynoate (for example METHYL OCTYNE CARBONATE), 2-phenethyl isobutanoate (for example PHENYL ETHYL ISOBUTYRATE), 5-isopropyl-2-methylphenol (for example CARVACROL), (E)-1-methoxy-4-(prop-1-en-1-yl)benzene (for example ANETHOLE), 3,7-dimethyloctan-1-ol (for example PELARGOL), (3aS,4S,7R,7aS)-ethyl octahydro-1H-4,7-methanoindene-3a-carboxylate (for example FRUITATE), (E)-3,7-dimethylocta-2,6-dien-1-yl acetate (for example GERANYL ACETATE), (Z)-3,7-dimethylocta-2,6-dien-1-ol (for example NEROLEX), 3,7-dimethyloct-6-en-1-yl formate (for example CITRONELLYL FORMATE), 2-(2,4-dimethylcyclohexyl)pyridine (for example ZINARINE); ingredients having equilibrium headspace concentration from 201 μg/l to about 300 μg/l, such as oxydibenzene (for example DIPHENYL OXIDE), 2-methylundecanal (for example ALDEHYDE C 12 MNA), bicyclo[2.2.2]oct-5-ene-2-carboxaldehyde (for example MACEAL), (3aR,6S,7aS)-3a,4,5,6,7,7a-hexahydro-1H-4,7-methanoinden-6-yl acetate (for example JASMACYCLENE), (Z)-3,7-dimethylocta-2,6-dien-1-yl acetate (for example NERYL ACETATE), (E)-1-(2,6,6-trimethylcyclohexa-1,3-dien-1-yl)but-2-en-1-one (for example DAMASCENONE), (E)-5-methylheptan-3-one oxime (for example STEMONE), (2-(isopentyloxy)ethyl)benzene (for example ANTHER), 2-(4-methylcyclohex-3-en-1-yl)propan-2-ol (for example LINDENOL), 1-(cyclopropylmethyl)-4-methoxybenzene (for example TOSCANOL), (Z)-4,11,11-trimethyl-8-methylenebicyclo[7.2.0]undec-4-ene (for example CARYOPHYLLENE), 2-phenylethanol (for example PHENYL ETHYL ALCOHOL); of ingredients having equilibrium headspace concentration from 301 μg/l to about 400 μg/l, such as 4-phenylbutan-2-one (for example BENZYL ACETONE), 1-(3,3-dimethylcyclohexyl)ethanol (for example CYCLADEMOL), 2-(2-mercaptopropan-2-yl)-5-methylcyclohexanone (for example CORPS CASSIS), 2-(4-methylcyclohex-3-en-1-yl)propan-2-ol (for example TERPINEOL), 2-(tert-pentyl)cyclohexyl acetate (for example CONIFERAN), 2,4,6-trimethyl-4-phenyl-1,3-dioxane (for example FLOROPAL), 3,7-dimethyloct-6-en-1-yl acetate (for example CITRONELLYL ACETATE), 2,4-dimethyl-4-phenyltetrahydrofuran (for example RHUBAFURAN), (E)-undec-9-enal (for example ALDEHYDE ISO C 11), 4-isopropylcyclohexanol (for example FOLROSIA), undecanal (for example ALDEHYDE C 110 UNDECYLIC), undecan-2-one (for example METHYL NONYL KETONE), 2-methyl-1-phenylpropan-2-yl acetate (for example DIMETHYL BENZYL CARBINYL ACETATE), (1S,2S,4S)-1,7,7-trimethylbicyclo[2.2.1]heptan-2-ol (for example BORNEOL CRYSTALS), 2-phenethyl acetate (for example PHENYL ETHYL ACETATE), 2-(4-methyl-1-cyclohex-3-enyl)propan-2-ol (for example TERPINEOL ALPHA), 4-(tert-butyl)cyclohexyl acetate (for example PARA TERT BUTYL CYCLOHEXYL ACETATE), 2-methyl-1-phenylpropan-2-ol (for example DIMETHYL BENZYL CARBINOL), 3-tert-butyl-cyclohexyl acetate (for example CYPERATE); ingredients having equilibrium headspace concentration from 401 μg/l to about 500 μg/l, such as (E)-3,7-dimethylocta-2,6-dienal (for example CITRAL TECH), 4-isopropylbenzaldehyde (for example CUMINIC ALDEHYDE), phenylmethanol (for example BENZYL ALCOHOL), decanenitrile (for example DECANONITRILE), 3,7-dimethyloct-6-enenitrile (for example CITRONELLYL NITRILE), (E)-3,7-dimethylocta-2,6-dien-1-yl formate (for example GERANYL FORMATE), 2-(4-methylcyclohex-3-en-1-yl)propan-2-yl acetate (for example TERPINYL ACETATE), undec-10-enal (for example ALDEHYDE C 11 UNDECYLENIC), benzyl propionate (for example BENZYL PROPIONATE), p-cresol (for example PARA CRESOL); ingredients having equilibrium headspace concentration from 501 μg/l to about 600 μg/l, such as ethyl 2-hydroxybenzoate (for example ETHYL SALICYLATE), octan-1-ol (for example ALCOHOL C 8 OCTYLIC), 4-(tert-butyl)cyclohexanone (for example PARA TERT BUTYL CYCLOHEXANONE), 2-(tert-butyl)cyclohexanol (for example VERDOL), 3-phenylbutanal (for example TRIFERNAL), (E)-3,7-dimethylnona-1,6-dien-3-ol (for example ETHYL LINALOOL), (2E,6Z)-nona-2,6-dienenitrile (for example VIOLET NITRILE), 2-methyl-5-(prop-1-en-2-yl)cyclohex-2-enone (for example CARVONE LAEVO); ingredients having equilibrium headspace concentration from 601 μg/l to 900 μg/l, such as allyl 2-(isopentyloxy)acetate (for example ALLYL AMYL GLYCOLATE), 2-methyldecanal (for example ALDEHYDE C 11 MOA), 2-(4-methylcyclohexyl)propan-2-ol (for example DIHYDRO TERPINEOL), 2,6-dimethyloctan-2-ol (for example TETRAHYDRO MYRCENOL), 2-pentylcyclopentanone (for example QUINTONE), 6-methoxy-2,6-dimethylheptanal (for example METHOXY MELONAL), 1-phenylethyl acetate (for example GARDENOL), 2-(4-methylcyclohexyl)propan-2-yl acetate (for example MENTHANYL ACETATE), 1-(p-tolyl)ethanone (for example METHYL ACETOPHENONE), 2-(tert-butyl)cyclohexyl acetate (for example AGRUMEX), ethyl 2-(2-methyl-1,3-dioxolan-2-yl)acetate (for example FRUCTONE), 2-methylpentyl 2-methylpentanoate (for example PERANAT), p-tolyl acetate (for example CRESYL ACETATE PARA); and mixtures thereof.

In another embodiment of the present invention, there is provided fragrance compositions comprising:

a) less than 20% by weight of the fragrance composition consist of perfumery ingredients having an equilibrium headspace concentration 151 and 900 microgram/l at 25° C., defined as Group A ingredients; and b) more than 40% by weight of the fragrance composition consist of GROUP B perfumery ingredients having an equilibrium headspace concentration higher than 900 microgram/l at 25° C., comprising more than 15% by weight, more particularly more than 20% by weight, still more particularly more than 25% by weight of FRUITY and GREEN ingredients, selected from, to the group consisting of allyl hexanoate (for example ALLYL CAPROATE); ethyl hexanoate (for example ETHYL CAPROATE); allyl heptanoate (for example ALLYL OENANTHATE); 3-methylbutyl acetate (for example ISOAMYL ACETATE); 3-methylbut-2-en-1-yl acetate (for example PRENYL ACETATE); pentyl butanoate (for example AMYL BUTYRATE); 6-methylheptan-3-one (for example ETHYL ISOAMYL KETONE); 3-methylbutyl butanoate (for example ISOAMYL BUTYRATE FR); 4-methylpent-4-en-2-yl 2-methylpropanoate (for example ISOPENTYRATE); heptan-2-one (for example METHYL AMYL KETONE); ethyl butanoate (for example ETHYL BUTYRATE); ethyl 2-methylpentanoate (for example MANZANATE); ethyl 2-methylbutanoate (for example ETHYL METHYL-2-BUTYRATE); (4S)-4,7,7-trimethyl-6-thiabicyclo[3.2.1]octane (for example CORPS PAMPLEMOUSSE); 2-methyl-4-propyl-1,3-oxathiane (for example OXANE); (Z)-hex-3-en-1-yl methyl carbonate (for example LIFFAROME); (Z)-hex-3-en-1-yl acetate (for example HEXENYL-3-CIS ACETATE); hexyl acetate (for example ACETATE C 6 HEXYLIC); 2,6-dimethylhept-5-enal (for example MELONAL); benzaldehyde; hexanal (for example ALDEHYDE C 6 HEXYLIC); (Z)-hex-3-en-1-ol (for example HEXENOL-3-CIS); 4-vinylcyclohex-1-enecarbaldehyde (for example SHISOLIA); 2,4-dimethylcyclohex-3-enecarbaldehyde (for example CYCLAL C; 2,4-dimethylcyclohex-3-enecarbaldehyde (for example TRICYCLAL); 7-methyl-3-methyleneocta-1,6-diene (for example MYRCENE); (3E,5Z)-undeca-1,3,5-triene (for example UNDECATRIENE); (2E,6Z)-nona-2,6-dienal (for example NONADIENAL); 4-methyl-2-(2-methylprop-1-en-1-yl)tetrahydro-2H-pyran (for example ROSE OXIDE); and mixtures thereof; and c) more than 40% of the fragrance composition consist of GROUP C perfumery ingredients having an equilibrium head space concentration lower than or equal to 150 microgram/l at 25° C., comprising more than 15% by weight, more particularly more than 20% by weight, still more particularly more than 25% by weight of SWEET and FLORAL ingredients, selected from to the group consisting of 2H-chromen-2-one (for example COUMARIN); octahydro-2H-chromen-2-one (for example BICYCLO NONALACTONE); 3-hydroxy-2-methyl-4H-pyran-4-one (for example MALTOL); 2-ethyl-3-hydroxy-4H-pyran-4-one (for example ETHYL MALTOL); benzo[d][1,3]dioxole-5-carbaldehyde (for example HELIOTROPINE); 4-formyl-2-methoxyphenyl isobutanoate (for example ISOBUTAVAN); 3-ethoxy-4-hydroxybenzaldehyde (for example ETHYL VANILLIN); 4-allyl-2-methoxyphenol (for example EUGENOL); (E)-2-methoxy-4-(prop-1-en-1-yl)phenol (for example ISOEUGENOL); 4-allyl-2-methoxyphenyl acetate (for example EUGENYL ACETATE); (E)-1,2-dimethoxy-4-(prop-1-en-1-yl) benzene (for example METHYL ISOEUGENOL); 2-methoxy-4-propylphenol (for example DIHYDRO EUGENOL); 3-phenylprop-2-enyl 3-phenylprop-2-enoate (for example CINNAMYL CINNAMATE); (2E)-3-phenylprop-2-enal (for example CINNAMIC ALDEHYDE); (E)-3-phenylprop-2-enenitrile (for example CINNAMALVA); of 4-(2,6,6-trimethylcyclohex-1-en-1-yl)butan-2-one (for example DIHYDRO IONONE BETA); 7,9-dimethylspiro[5.5]undecan-3-one (for example DISPIRONE); (E)-4-(2,6,6-trimethylcyclohex-1-en-1-yl)but-3-en-2-one (for example IONONE BETA); (E)-4-(2,5,6,6-tetramethylcyclohex-2-en-1-yl)but-3-en-2-one (for example IRONE ALPHA); (E)-3-methyl-4-(2,6,6-trimethylcyclohex-2-en-1-yl)but-3-en-2-one (for example ISORALDEINE 70); methyl 2-(methylamino)benzoate (for example DIMETHYL ANTHRANILATE); methyl 2-aminobenzoate (for example METHYL ANTHRANILATE); 1-(2-naphtalenyl)-ethanone (for example ORANGER CRYSTALS); 2-ethoxynaphthalene (for example NEROLINE CRYSTALS); 2-methoxynaphthalene (for example YARA YARA); (4-methoxyphenyl)methanol (for example ANISYL ALCOHOL); 2-hexylcyclopent-2-enone (for example ISOJASMONE T); (Z)-3-methyl-2-(pent-2-en-1-yl)cyclopent-2-enone (for example JASMONE CIS); (Z)-6-(pent-2-en-1-yl)tetrahydro-2H-pyran-2-one (for example JASMIN LACTONE DELTA); pentyl 2-hydroxybenzoate (for example AMYL SALICYLATE); hexyl 2-hydroxybenzoate (for example HEXYL SALICYLATE); (4Z)-hept-4-en-2-yl 2-hydroxybenzoate (for example KARMAFLOR); benzyl 2-hydroxybenzoate (for example BENZYL SALICYLATE); 4-cyclohexyl-2-methylbutan-2-ol (for example CORANOL); tetrahydro-4-methyl-2-(2-methylpropyl)-2H-pyran-4-ol (for example FLOROSA HC); (4E)-9-hydroxy-5,9-dimethyl-4-decenal (for example MAHONIAL); 3-(4-isopropylphenyl)-2-methylpropanal (for example CYCLAMEN ALDEHYDE); 3-(4-(tert-butyl)phenyl) propanal (for example BOURGEONAL); 3-(benzo[d][1,3]dioxol-5-yl)-2-methylpropanal (for example TROPIONAL); (E)-4-((3aS,7aS)-hexahydro-1H-4,7-methanoinden-5(6H)-ylidene)butanal (for example DUPICAL); 3-(4-ethylphenyl)-2,2-dimethylpropanal (for example FLORALOZONE); tetrahydro-4-methyl-2-(2-methylpropyl)-2H-pyran-4-ol (for example FLOROSA); 3-(4-(tert-butyl)phenyl)-2-methylpropanal (for example LILIAL); 2,2-dimethyl-3-(m-tolyl)propan-1-ol (for example MAJANTOL); 4-(4-methylpent-3-en-1-yl)cyclohex-3-enecarbaldehyde (for example MYRALDENE); dec-9-en-1-ol (for example ROSALVA); 3-(3-isopropylphenyl)butanal (for example FLORHYDRAL); 3-(4-isobutyl-2-methylphenyl)propanal (for example NYMPHEAL); (E)-3-phenylprop-2-en-1-ol (for example CINNAMIC ALCOHOL); 3-phenylpropan-1-ol (for example PHENYL PROPYL ALCOHOL); (1-methyl-2-(5-methylhex-4-en-2-yl)cyclopropyl)methanol (for example ROSYFOLIA); 3,7-dimethyloct-6-en-1-ol (for example CITRONELLOL); (E)-3,7-dimethylocta-2,6-dien-1-ol (for example GERANIOL); 3-methyl-5-phenylpentan-1-ol (for example MEFROSOL); 2,2,2-trichloro-1-phenylethyl acetate (for example ROSACETOL); 2-cyclohexylidene-2-phenylacetonitrile (for example PEONILE); 2-methyl-4-phenylbutan-2-ol (for example DIMETHYL PHENYL ETHYL CARBINOL); and mixtures thereof.

In another embodiment of the present invention, there is provided fragrance compositions comprising:

a) less than 20% by weight of the fragrance composition consist of perfumery ingredients having an equilibrium headspace concentration between 151 and 900 microgram/l at 25° C., defined as Group A ingredients; and b) more than 40% by weight of the fragrance composition consist of GROUP B perfumery ingredients having an equilibrium headspace concentration higher than 900 microgram/l at 25° C., comprising more than 15% by weight, more particularly more than 20% by weight, still more particularly more than 25% by weight of initial CITRUS ingredients, selected from, but not limited to 3,7-dimethyloct-6-enal (for example CITRONELLAL); 4,7-dimethyloct-6-en-3-one (for example DIMETHYL OCTENONE); 6,6-dimethoxy-2,5,5-trimethylhex-2-ene (for example METHYL PAMPLEMOUSSE); 1-phenylethanethiol (for example ANJERUK); 1-methyl-4-(prop-1-en-2-yl)cyclohex-1-ene (for example DIPENTENE); (4R)-1-methyl-4-(1-methylvinyl)cyclohexene (for example LIMONENE LAEVO); 1-methyl-4-(propan-2-ylidene)cyclohex-1-ene (for example TERPINOLENE); octanal (for example ALDEHYDE C 8 OCTYLIC); nonanal (for example ALDEHYDE C 9 NONYLIC); 3,5,5-trimethylhexanal (for example ALDEHYDE C 9 ISONONYLIC); (E)-dec-4-enal (for example DECENAL-4-TRANS); decanal (for example ALDEHYDE C 10); heptanal (for example ALDEHYDE C 7 HEPTYLIC) and mixtures thereof;

c) more than 40% of the fragrance composition consist of GROUP C perfumery ingredients having an equilibrium headspace concentration lower than or equal to 150 microgram/l at 25° C., comprising more than 15% by weight, more particularly more than 20% by weight, still more particularly more than 25% by weight of long lasting SWEET and MUSKY ingredients, selected from but not limited to 2H-chromen-2-one (for example COUMARIN); octahydro-2H-chromen-2-one (for example BICYCLO NONALACTONE); 3-hydroxy-2-methyl-4H-pyran-4-one (for example MALTOL); 2-ethyl-3-hydroxy-4H-pyran-4-one (for example ETHYL); benzo[d][1,3]dioxole-5-carbaldehyde (for example HELIOTROPINE); 4-formyl-2-methoxyphenyl isobutanoate (for example ISOBUTAVAN); 3-ethoxy-4-hydroxybenzaldehyde (for example ETHYL VANILLIN); 4-allyl-2-methoxyphenol (for example EUGENOL); (E)-2-methoxy-4-(prop-1-en-1-yl)phenol (for example ISOEUGENOL); 4-allyl-2-methoxyphenyl acetate (for example EUGENYL ACETATE); (E)-1,2-dimethoxy-4-(prop-1-en-1-yl) benzene (for example METHYL ISOEUGENOL); 2-methoxy-4-propylphenol (for example DIHYDRO EUGENOL); 3-phenylprop-2-enyl 3-phenylprop-2-enoate (for example CINNAMYL CINNAMATE); (2E)-3-phenylprop-2-enal (for example CINNAMIC ALDEHYDE); (E)-3-phenylprop-2-enenitrile (for example CINNAMALVA); (Z)-oxacycloheptadec-10-en-2-one (for example AMBRETTOLIDE); (Z)-cycloheptadec-9-enone (for example CIVETTONE); (Z)-3-methylcyclotetradec-5-enone (for example COSMONE); 1,4-dioxacycloheptadecane-5,17-dione (for example ETHYLENE BRASSYLATE); 4,6,6,7,8,8-hexamethyl-1,3,4,6,7,8-hexahydrocyclopenta[g]isochromene (for example GALAXOLIDE); (E)-oxacyclohexadec-12-en-2-one (for example HABANOLIDE); (Z)-3-methylcyclopentadec-5-enone (for example MUSCENONEl); 1,4-dioxacyclohexadecane-5,16-dione (for example MUSK C14); (E)-13-methyloxacyclopentadec-10-en-2-one (for example NIRVANOLIDE); 2-(1-(3,3-dimethylcyclohexyl) ethoxy)-2-methylpropyl cyclopropane-carboxylate (for example SERENOLIDE); (E)-2-((3,5-dimethylhex-3-en-2-yl)oxy)-2-methylpropyl cyclopropanecarboxylate (for example SYLKOLIDE); oxacyclohexadecan-2-one (for example THIBETOLIDE); (Z)-cyclohexadec-5-enone (for example VELVIONE); 1,1,2,3,3-pentamethyl-2,3,6,7-tetrahydro-1H-inden-4(5H)-one (for example CASHMERAN); 1a,3,3,4,6,6-hexamethyl-1a,2,3,4,5,6,7,7a-octahydronaphtho[2,3-b]oxirene (for example MOXALONE); cyclopentadecanone (for example MUSK CPD); 1-oxacycloheptadecan-2-one (for example DIHYDRO AMBRETTOLIDE); and mixtures thereof.

In another embodiment of the present invention, there is provided fragrance compositions comprising:

a) less than 20% by weight of the fragrance composition consist of perfumery ingredients having an equilibrium headspace concentration 151 and 900 microgram/l at 25° C., defined as Group A ingredients; and b) more than 55% by weight of the fragrance composition consist of GROUP B perfumery ingredients having an equilibrium headspace concentration higher than 900 microgram/l at 25° C., comprising more than 15% by weight, more particularly more than 20% by weight, still more particularly more than 25% by weight of initial CITRUS/ALDEHYDIC, GREEN, AROMATIC/HERBAL and FRUITY ingredients, selected from, 3,7-dimethyloct-6-enal (for example CITRONELLAL); 4,7-dimethyloct-6-en-3-one (for example DIMETHYL OCTENONE); 6,6-dimethoxy-2,5,5-trimethylhex-2-ene (for example METHYL PAMPLEMOUSSE); 1-phenylethanethiol (for example ANJERUK); 1-methyl-4-(prop-1-en-2-yl)cyclohex-1-ene (for example DIPENTENE); (4R)-1-methyl-4-(1-methylvinyl)cyclohexene (for example LIMONENE LAEVO); 1-methyl-4-(propan-2-ylidene)cyclohex-1-ene (for example TERPINOLENE); octanal (for example ALDEHYDE C 8 OCTYLIC); nonanal (for example ALDEHYDE C 9 NONYLIC); 3,5,5-trimethylhexanal (for example ALDEHYDE C 9 ISONONYLIC); (E)-dec-4-enal (for example DECENAL-4-TRANS); decanal (for example ALDEHYDE C 10 DECYLIC); heptanal (for example ALDEHYDE C 7 HEPTYLIC); (2S)-1,3,3-trimethylbicyclo[2.2.1]heptan-2-yl acetate (for example FENCHYL ACETATE); (1S,2R,4R)-1,3,3-trimethylbicyclo[2.2.1]heptan-2-ol (for example FENCHYL ALCOHOL); (1S,4S)-1,7,7-trimethylbicyclo[2.2.1]heptan-2-one (for example CAMPHOR); (2S,4S)-1,7,7-trimethylbicyclo[2.2.1]heptan-2-yl acetate (for example BORNYL ACETATE LIQUID); 2,6,6-trimethylbicyclo[3.1.1]hept-2-ene (for example PINENE ALPHA); 6,6-dimethyl-2-methylenebicyclo[3.1.1]heptane (for example PINENE BETA); 1-methyl-4-propan-2-ylbenzene (for example CYMENE PARA); 1-methyl-4-propan-2-ylcyclohexa-1,4-diene (for example TERPINENE GAMMA); 2,2,6-trimethyl-6-vinyltetrahydro-2H-pyran (for example LIMETOL); 3,7-dimethylocta-1,6-dien-3-yl acetate (for example LINALYL ACETATE); 2,6-dimethyloct-7-en-2-ol (for example DIMYRCETOL); (1s,4s)-1,3,3-trimethyl-2-oxabicyclo[2.2.2]octane (for example EUCALYPTOL); 2-(sec-butyl)cyclohexanone (for example FRESKOMENTHE); 2-isopropyl-5-methylcyclohexanone (for example MENTHONE); 2-isopropyl-5-methylcyclohexanone (for example ISOMENTHONE DL); of allyl hexanoate (for example ALLYL CAPROATE); ethyl hexanoate (for example ETHYL CAPROATE); allyl heptanoate (for example ALLYL OENANTHATE); 3-methylbutyl acetate (for example ISOAMYL ACETATE); 3-methylbut-2-en-1-yl acetate (for example PRENYL ACETATE); pentyl butanoate (for example AMYL BUTYRATE); 6-methylheptan-3-one (for example ETHYL ISOAMYL KETONE); 3-methylbutyl butanoate (for example ISOAMYL BUTYRATE); 4-methylpent-4-en-2-yl 2-methylpropanoate (for example ISOPENTYRATE); heptan-2-one (for example METHYL AMYL KETONE); ethyl butanoate (for example ETHYL BUTYRATE); ethyl 2-methylpentanoate (for example MANZANATE); ethyl 2-methylbutanoate (for example ETHYL METHYL-2-BUTYRATE); (4S)-4,7,7-trimethyl-6-thiabicyclo[3.2.1]octane (for example CORPS PAMPLEMOUSSE); 2-methyl-4-propyl-1,3-oxathiane (for example OXANE); (Z)-hex-3-en-1-yl methyl carbonate (for example LIFFAROME); (Z)-hex-3-en-1-yl acetate (for example HEXENYL-3-CIS ACETATE); hexyl acetate (for example ACETATE C 6 HEXYLIC); 2,6-dimethylhept-5-enal (for example MELONAL); benzaldehyde; and mixtures thereof; and c) more than 25% of the fragrance composition consist of GROUP C perfumery ingredients having an equilibrium headspace concentration lower than or equal to 150 microgram/l at 25° C., comprising more than 15% by weight, more particularly more than 20% by weight, still more particularly more than 25% by weight of long lasting AMBER/WOODY and FLORAL (Isoraldeine) ingredients, selected from but not limited to 3-methoxy-5-methylphenol (for example ORCINYL 3); (Z)-1-(cyclooct-3-en-1-yl)propan-1-ol (for example FLORYMOSS); methyl 2,4-dihydroxy-3,6-dimethylbenzoate (for example EVERNYL); (1-methyl-2-

(((1R,3R)-2,2,3-trimethylcyclopentyl)methyl)cyclopropyl)methanol (for example PASHMINOL); 7-methoxy-3,7-dimethyloctan-2-ol (for example OSYROL); (E)-2-methyl-4-(2,2,3-trimethyl-1-cyclopent-3-enyl)but-2-en-1-ol (for example BRAHMANOL F); (E)-3-methyl-5-(2,2,3-trimethylcyclopent-3-en-1-yl) pent-4-en-2-ol (for example EBANOL); (1-methyl-2-((1,2,2-trimethylbicyclo[3.1.0]hexan-3-yl)methyl)cyclopropyl)methanol (for example JAVANOL); (E)-3,3-dimethyl-5-(2,2,3-trimethyl-3-cyclopenten-1-yl)-4-penten-2-ol (for example POLYSANTOL); (E)-2-ethyl-4-(2,2,3-trimethylcyclopent-3-en-1-yl)but-2-en-1-ol (for example RADJANOL); 3-((1R,2S,4R,6R)-5,5,6-trimethylbicyclo[2.2.1]heptan-2-yl)cyclohexanol (for example SANDELA CONCENTRATED); (E)-2-methyl-4-(2,2,3-trimethyl-1-cyclopent-3-enyl)but-2-en-1-ol (for example SANTACORE); 3-methyl-5-(2,2,3-trimethylcyclopent-3-en-1-yl)pentan-2-ol (for example SANDALORE); 4-(tert-butyl)cyclohexyl acetate (for example BUTYL CYCLOHEXYL ACETATE PARA); 2-(tert-pentyl)cyclohexyl acetate (for example CONIFERAN); 2-(4-methylcyclohexyl) propan-2-yl acetate (for example MENTHANYL ACETATE); (1S,2R,5R)-2-ethoxy-2,6,6-trimethyl-9-methylenebicyclo[3.3.1]nonane (for example BOISIRIS); ((1S,8aR)-1,4,4-trimethyl-2,3,3a,4,5,8-hexahydro-1H-5,8a-methanoazulen-6-yl)methanol (for example CEDRENOL); (1S,6R,8aR)-1,4,4,6-tetramethyloctahydro-1H-5,8a-methanoazulen-6-yl acetate (for example CEDRYL ACETATE CRYSTALS); 2-(3,8-dimethyl-1,2,3,4,5,6,7,8-octahydroazulen-5-yl)propan-2-yl acetate (for example GUAIYL ACETATE); 1-(2,3,8,8-tetramethyl-1,2,3,4,5,6,7,8-octahydronaphthalen-2-yl)ethanone (for example ISOCYCLEMONE E); 1-(2,3,8,8-tetramethyl-1,2,3,4,5,6,7,8-octahydronaphthalen-2-yl)ethanone (for example ISO E SUPER); 4-(1-ethoxyvinyl)-3,3,5,5-tetramethylcyclohexanone (for example KEPHALIS); 1-(1,2,8,8-tetramethyl-1,2,3,4,5,6,7,8-octahydronaphthalen-2-yl) ethanone (for example GEORGYWOOD); 1-((1S,8aS)-1,4,4,6-tetramethyl-2,3,3a,4,5,8-hexahydro-1H-5,8a-methanoazulen-7-yl)ethanone (for example METHYL CEDRYL KETONE); 1-((1S,8aS)-1,4,4,6-tetramethyl-2,3,3a,4,5,8-hexahydro-1H-5,8a-methanoazulen-7-yl)ethanone (for example VERTOFIX COEUR); N-ethyl-N-(m-tolyl)propionamide (for example AGARBOIS); 1-((2-(tert-butyl)cyclohexyl) oxy)butan-2-ol (for example AMBER CORE); 3,8,8,11a-tetramethyldodecahydro-1H-3,5a-epoxynaphtho[2,1-c]oxepine (for example AMBERKETAL); (4aR,5R,7aS,9R)-Octahydro-2,2,5,8,8,89a-hexamethyl-4H-4a,9-methanoazuleno[5,6-d]-1,3-dioxole (for example AMBROCENIDE); (ethoxymethoxy)cyclododecane (for example BOISAMBRENE FORTE); (4Z,8Z)-1,5,9-trimethyl-13-oxabicyclo[10.1.0]trideca-4,8-diene (for example CEDROXYDE); 2-(2-(3,3,5-trimethylcyclohexyl)acetyl)cyclopentanone (for example DIONE); 3a-ethyl-6,6,9a-trimethyldodecahydronaphtho[1,2-c]furan (for example GRISALVA); 5-(sec-butyl)-2-(2,4-dimethylcyclohex-3-en-1-yl)-5-methyl-1,3-dioxane (for example KARANAL); 2-(sec-butyl)-1-methylcyclohexyl acetate (for example METAMBRATE); 2,4-dimethyl-2-(5,5,8,8-tetramethyl-5,6,7,8-tetrahydronaphthalen-2-yl)-1,3-dioxolane (for example OKOUMAL); 1-(2,2,6-trimethylcyclohexyl)hexan-3-ol (for example TIMBEROL); 2',2',3,7,7-pentamethylspiro[bicyclo[4.1.0]heptane-2,5'-[1,3]dioxane] (for example SPIRAMBRENE); (7,7,8,8-tetramethyloctahydro-2,3b-methanocyclopenta[1,3]cyclopropa[1,2]benzen-4-yl)methyl acetate (for example AMBORYL ACETATE); (1R,2S,4R)-2'-isopropyl-1,7,7-trimethylspiro[bicyclo[2.2.1]heptane-2,4'-[1,3]dioxane] (for example BELAMBRE); (1R,6S,8aS)-6-methoxy-1,4,4,6-tetramethyloctahydro-1H-5,8a-methanoazulene (for example CEDRYL METHYL ETHER); 2,4a,5,8a-tetramethyl-1,2,3,4,4a,7,8,8a-octahydronaphthalen-1-yl formate (for example OXYOCTALINE FORMATE); Patchouli oil; 4,8a,9,9-tetramethyldecahydro-1,6-methanonaphthalen-1-ol (for example PATCHOULI ALCOHOL); 4-(2,6,6-trimethylcyclohex-1-en-1-yl) butan-2-one (for example DIHYDRO IONONE BETA); 7,9-dimethylspiro[5.5]undecan-3-one (for example DISPIRONE); (E)-4-(2,6,6-trimethylcyclohex-1-en-1-yl)but-3-en-2-one (for example IONONE BETA); (E)-4-(2,5,6,6-tetramethylcyclohex-2-en-1-yl) but-3-en-2-one (for example IRONE ALPHA); (E)-3-methyl-4-(2,6,6-trimethylcyclohex-2-en-1-yl)but-3-en-2-one (for example ISORALDEINE 70); methyl 2-(methylamino)benzoate (for example DIMETHYL ANTHRANILATE); methyl 2-aminobenzoate (for example METHYL ANTHRANILATE); 1-(2-naphtalenyl)-ethanone (for example ORANGER CRYSTALS); 2-ethoxynaphthalene (for example NEROLINE CRYSTALS); 2-methoxynaphthalene (for example YARA YARA); (4-methoxyphenyl)methanol (for example ANISYL ALCOHOL); 2-hexylcyclopent-2-enone (for example ISOJASMONE T); (Z)-3-methyl-2-(pent-2-en-1-yl)cyclopent-2-enone (for example JASMONE CIS); (Z)-6-(pent-2-en-1-yl)tetrahydro-2H-pyran-2-one (for example JASMIN LACTONE DELTA); pentyl 2-hydroxybenzoate (for example AMYL SALICYLATE); hexyl 2-hydroxybenzoate (for example HEXYL SALICYLATE); (4Z)-hept-4-en-2-yl 2-hydroxybenzoate (for example KARMAFLOR); benzyl 2-hydroxybenzoate (for example BENZYL SALICYLATE); 4-cyclohexyl-2-methylbutan-2-ol (for example CORANOL); tetrahydro-4-methyl-2-(2-methylpropyl)-2H-pyran-4-ol (for example FLOROSA HC); (4E)-9-hydroxy-5,9-dimethyl-4-decenal (for example MAHONIAL); 3-(4-isopropylphenyl)-2-methylpropanal (for example CYCLAMEN ALDEHYDE); 3-(4-(tert-butyl)phenyl) propanal (for example BOURGEONAL); 3-(benzo[d][1,3]dioxol-5-yl)-2-methylpropanal (for example TROPIONAL); (E)-4-((3aS,7aS)-hexahydro-1H-4,7-methanoinden-5 (6H)-ylidene)butanal (for example DUPICAL); 3-(4-ethylphenyl)-2,2-dimethylpropanal (for example FLORALOZONE); tetrahydro-4-methyl-2-(2-methylpropyl)-2H-pyran-4-ol (for example FLOROSA); 3-(4-(tert-butyl)phenyl)-2-methylpropanal (for example LILIAL); 2,2-dimethyl-3-(m-tolyl)propan-1-ol (for example MAJANTOL); 4-(4-methylpent-3-en-1-yl)cyclohex-3-enecarbaldehyde (for example MYRALDENE); dec-9-en-1-ol (for example ROSALVA); 3-(3-isopropylphenyl)butanal (for example FLORHYDRAL); 3-(4-isobutyl-2-methylphenyl)propanal (for example NYMPHEAL); (E)-3-phenylprop-2-en-1-ol (for example CINNAMIC ALCOHOL); 3-phenylpropan-1-ol (for example PHENYL PROPYL ALCOHOL); (1-methyl-2-(5-methylhex-4-en-2-yl)cyclopropyl)methanol (for example ROSYFOLIA); 3,7-dimethyloct-6-en-1-ol (for example CITRONELLOL); (E)-3,7-dimethylocta-2,6-dien-1-ol (for example GERANIOL); 3-methyl-5-phenylpentan-1-ol (for example MEFROSOL); 2,2,2-trichloro-1-phenylethyl acetate (for example ROSACETOL); 2-cyclohexylidene-2-phenylacetonitrile (for example PEONILE); 2-methyl-4-phenylbutan-2-ol (for example DIMETHYL PHENYL ETHYL CARBINOL); and mixtures thereof.

In another embodiment of the present invention, there is provided fragrance compositions comprising:

a) less than 20% by weight of the fragrance composition consist of perfumery ingredients having an equilibrium headspace concentration 151 and 900 microgram/i at 25° C., defined as Group A ingredients; and b) more than 40% by weight of the fragrance composition consist of GROUP B perfumery ingredients having an equilibrium headspace concentration higher than 900 microgram/i at 25° C., comprising more than 15% by weight, more particularly more than 20% by weight, still more particularly more than 25% by weight of initial FRUITY/GREEN/WATERY ingredients, selected from, but not limited to allyl hexanoate (for example ALLYL CAPROATE); ethyl hexanoate (for example ETHYL CAPROATE); allyl heptanoate (for example ALLYL OENANTHATE); 3-methylbutyl acetate (for example ISOAMYL ACETATE); 3-methylbut-2-en-1-yl acetate (for example PRENYL ACETATE); pentyl butanoate (for example AMYL BUTYRATE); 6-methylheptan-3-one (for example ETHYL ISOAMYL KETONE); 3-methylbutyl butanoate (for example ISOAMYL BUTYRATE); 4-methylpent-4-en-2-yl 2-methylpropanoate (for example ISOPENTYRATE); heptan-2-one (for example METHYL AMYL KETONE); ethyl butanoate (for example ETHYL BUTYRATE); ethyl 2-methylpentanoate (for example MANZANATE); ethyl 2-methylbutanoate (for example ETHYL METHYL-2-BUTYRATE); (4S)-4,7,7-trimethyl-6-thiabicyclo[3.2.1]octane (for example CORPS PAMPLEMOUSSE); 2-methyl-4-propyl-1,3-oxathiane (for example OXANE); (Z)-hex-3-en-1-yl methyl carbonate (for example LIFFAROME); (Z)-hex-3-en-1-yl acetate (for example HEXENYL-3-CIS ACETATE); hexyl acetate (for example ACETATE C 6 HEXYLIC); 2,6-dimethylhept-5-enal (for example MELONAL); benzaldehyde; hexanal (for example ALDEHYDE C 6 HEXYLIC); (Z)-hex-3-en-1-ol (for example HEXENOL-3-CIS); 4-vinylcyclohex-1-enecarbaldehyde (for example SHISOLIA); 2,4-dimethylcyclohex-3-enecarbaldehyde (for example CYCLAL C); 2,4-dimethylcyclohex-3-enecarbaldehyde (for example TRICYCLAL); 7-methyl-3-methyleneocta-1,6-diene (for example MYRCENE); (3E,5Z)-undeca-1,3,5-triene (for example UNDECATRIENE); (2E,6Z)-nona-2,6-dienal (for example NONADIENAL); 4-methyl-2-(2-methylprop-1-en-1-yl)tetrahydro-2H-pyran (for example ROSE OXIDE); and mixtures thereof; and c) more than 40% of the fragrance composition consist of GROUP C perfumery ingredients having an equilibrium headspace concentration lower than or equal to 150 microgram/l at 25° C., comprising more than 15% by weight, more particularly more than 20% by weight, still more particularly more than 25% by weight of long lasting WOODY/AMBERY/WOODY/FRUITY (Peach/Cassis/Coconut/Strawberry) ingredients, selected from but not limited to 3-methoxy-5-methylphenol (for example 3-methoxy-5-methylphenol (for example ORCINYL 3); (Z)-1-(cyclooct-3-en-1-yl)propan-1-ol (for example FLORYMOSS); methyl 2,4-dihydroxy-3,6-dimethylbenzoate (for example EVERNYL); (1-methyl-2-(((1R,3R)-2,2,3-trimethylcyclopentyl)methyl)-cyclopropyl)methanol (for example PASHMINOL); 7-methoxy-3,7-dimethyloctan-2-ol (for example OSYROL); (E)-2-methyl-4-(2,2,3-trimethyl-1-cyclopent-3-enyl)but-2-en-1-ol (for example BRAHMANOL F); (E)-3-methyl-5-(2,2,3-trimethylcyclopent-3-en-1-yl)pent-4-en-2-ol (for example EBANOL); (1-methyl-2-((1,2,2-trimethylbicyclo[3.1.0]hexan-3-yl)methyl)cyclopropyl)methanol (for example JAVANOL); (E)-3,3-dimethyl-5-(2,2,3-trimethyl-3-cyclopenten-1-yl)-4-penten-2-ol (for example POLYSANTOL); (E)-2-ethyl-4-(2,2,3-trimethylcyclopent-3-en-1-yl)but-2-en-1-ol (for example RADJANOL); 3-((1R,2S,4R,6R)-5,5,6-trimethylbicyclo[2.2.1]heptan-2-yl)cyclohexanol (for example SANDELA CONCENTRATED); (E)-2-methyl-4-(2,2,3-trimethyl-1-cyclopent-3-enyl)but-2-en-1-ol (for example SANTACORE); 3-methyl-5-(2,2,3-trimethylcyclopent-3-en-1-yl)pentan-2-ol (for example SANDALORE); 4-(tert-butyl)cyclohexyl acetate (for example BUTYL CYCLOHEXYL ACETATE PARA); 2-(tert-pentyl)cyclohexyl acetate (for example CONIFERAN); 2-(4-methylcyclohexyl)propan-2-yl acetate (for example MENTHANYL ACETATE); (1S,2R,5R)-2-ethoxy-2,6,6-trimethyl-9-methylenebicyclo[3.3.1]nonane (for example BOISIRIS); ((1S,8aR)-1,4,4-trimethyl-2,3,3a,4,5,8-hexahydro-1H-5,8a-methanoazulen-6-yl)methanol (for example CEDRENOL); (1S,6R,8aR)-1,4,4,6-tetramethyloctahydro-1H-5,8a-methanoazulen-6-yl acetate (for example CEDRYL ACETATE CRYSTALS); 2-(3,8-dimethyl-1,2,3,4,5,6,7,8-octahydroazulen-5-yl)propan-2-yl acetate (for example GUAIYL ACETATE); 1-(2,3,8,8-tetramethyl-1,2,3,4,5,6,7,8-octahydronaphthalen-2-yl)ethanone (for example ISOCYCLEMONE E); 1-(2,3,8,8-tetramethyl-1,2,3,4,5,6,7,8-octahydronaphthalen-2-yl)ethanone (for example ISO E SUPER); 4-(1-ethoxyvinyl)-3,3,5,5-tetramethylcyclohexanone (for example KEPHALIS); 1-(1,2,8,8-tetramethyl-1,2,3,4,5,6,7,8-octahydronaphthalen-2-yl)ethanone (for example GEORGYWOOD); 1-((1S,8aS)-1,4,4,6-tetramethyl-2,3,3a,4,5,8-hexahydro-1H-5,8a-methanoazulen-7-yl)ethanone (for example METHYL CEDRYL KETONE); 1-((1S,8aS)-1,4,4,6-tetramethyl-2,3,3a,4,5,8-hexahydro-1H-5,8a-methanoazulen-7-yl)ethanone (for example VERTOFIX COEUR); N-ethyl-N-(m-tolyl)propionamide (for example AGARBOIS); 1-((2-(tert-butyl)cyclohexyl)oxy)butan-2-ol (for example AMBER CORE); 3,8,8,11a-tetramethyldodecahydro-1H-3,5a-epoxynaphtho[2,1-c]oxepine (for example AMBERKETAL); (4aR,5R,7aS,9R)-Octahydro-2,2,5,8,8,9a-hexamethyl-4H-4a,9-methanoazuleno[5,6-d]-1,3-dioxole (for example AMBROCENIDE); (ethoxymethoxy)cyclododecane (for example BOISAMBRENE FORTE); (4Z,8Z)-1,5,9-trimethyl-13-oxabicyclo[10.1.0]trideca-4,8-diene (for example CEDROXYDE); 2-(2-(3,3,5-trimethylcyclohexyl)acetyl)cyclopentanone (for example DIONE); 3a-ethyl-6,6,9a-trimethyldodecahydronaphtho[1,2-c]furan (for example GRISALVA); 5-(sec-butyl)-2-(2,4-dimethylcyclohex-3-en-1-yl)-5-methyl-1,3-dioxane (for example KARANAL); 2-(sec-butyl)-1-methylcyclohexyl acetate (for example METAMBRATE); 2,4-dimethyl-2-(5,5,8,8-tetramethyl-5,6,7,8-tetrahydronaphthalen-2-yl)-1,3-dioxolane (for example OKOUMAL); 1-(2,2,6-trimethylcyclohexyl)hexan-3-ol (for example TIMBEROL); 2',2',3,7,7-pentamethylspiro[bicyclo[4.1.0]heptane-2,5'-[1,3]dioxane] (for example SPIRAMBRENE); (7,7,8,8-tetramethyloctahydro-2,3b-methanocyclopenta[1,3]cyclopropa[1,2] benzen-4-yl)methyl acetate (for example AMBORYL ACETATE); (1R,2S,4R)-2'-isopropyl-1,7,7-trimethylspiro[bicyclo[2.2.1]heptane-2,4'-[1,3]dioxane] (for example BELAMBRE); (1R,6S,8aS)-6-methoxy-1,4,4,6-tetramethyloctahydro-1H-5,8a-methanoazulene (for example CEDRYL METHYL ETHER); 2,4a,5,8a-tetramethyl-1,2,3,4,4a,7,8,8a-octahydronaphthalen-1-yl formate (for example OXYOCTALINE FORMATE); Patchouli oil; 4,8a,9,9-tetramethyldecahydro-1,6-methanonaphthalen-1-ol (for example PATCHOULI ALCOHOL); 6-pentyltetrahydro-2H-pyran-2-one (for example 6-pentyltetrahydro-2H-pyran-2-one (for example DECALACTONE DELTA); 5-hexyloxolan-2-one (for example DECALACTONE GAMMA); 6-heptyltetrahydro-2H-pyran-2-one (for example DODECALACTONE DELTA); 5-octyloxolan-2-one (for example DODECALACTONE GAMMA); 6-hexyltetrahydro-2H-pyran-2-one (for example UNDECALACTONE DELTA); 6-propyltetrahydro-2H-pyran-2-one (for example OCTALACTONE DELTA); 5-pentyldihydrofuran-2(3H)-one (for example PRUNOLIDE); 4-methyl-5-pentyldihydrofuran-2(3H)-one (for example METHYL TUBERATE); ethyl 6-acetoxyhexanoate (for example BERRYFLOR); 4-(4-hydroxyphenyl)butan-2-one (for example RASPBERRY KETONE); ethyl methyl phenyl glycidate (for example STRAWBERRY); 2-methyl-1-phenylpropan-2-yl butanoate (for example DIMETHYL BENZYL CARBINYL BUTYRATE); (E)-1-(2,6,6-trimethylcyclohex-1-en-1-yl)but-2-en-1-one (for example DAMASCONE BETA); and mixtures thereof.

The fragrance compositions according to the present invention may be admixed with various additives, such as solvents, antioxidants, chelating agents, preservatives, dyes, and the like. Furthermore, although the fragrance composition of the present invention is un-encapsulated, it may be combined with other encapsulated fragrance formulations if so desired for use in particular perfumed products.

Fragrance compositions according to the present invention are suitable for use in all manner of perfumed products or articles for use in home care, personal care and fabric care.

Fragrance compositions are particular suitable for use in perfumed products or articles for use in home care, personal care (e.g. cosmetics) and fabric care, that are intended to be applied to a substrate, such as hard surfaces, human or animal skin or hair, or fabric, in a wet state (i.e. the personal care product contains water and/or a water-miscible solvent, or a propellant), and which are intended to dry down on the substrate.

The fragrance compositions may be used at any suitable level depending on the nature of the perfumed product in which they are intended to be incorporated, and the intended use of the perfumed product. Typical usage levels will include from about 0.05 to 2% by weight of the perfumed product, more preferably from about 0.1 to 1% by weight of the perfumed product.

Typical perfumed products concerned by the present invention include home care products, such as hard surface cleaners, laundry care detergents, laundry care conditioners, fabric refreshers, personal care cleansing compositions, such as shampoos, bath and shower gels, liquid soaps, soap bars and the like, personal care conditioning composition, such as hair care conditioners, bath and shower lotions, deodorant compositions, antiperspirant compositions, home care compositions, such as hard surface cleaners, heavy duty detergents and the like.

In many cases, and especially in the home care categories, laundry care, personal care and, the consumer products concerned by the present invention contain surfactants.

In a particular embodiment of the present invention there is provided a perfumed product comprising a fragrance composition and at least one surfactant, selected from anionic, cationic, amphoteric or non-ionic surfactants. Typical anionic surfactants include but are not limited to sodium lauryl sulfate, sodium laureth sulfate, sodium trideceth sulfate, ammonium lauryl sulphate, ammonium laureth sulphate, potassium laureth sulfate, sodium tridecyl benzene sulfonate, sodium dodecyl benzene sulfonate, sodium xylene sulfonate, monoethanolamine lauryl sulfate, monoethanolamine laureth sulfate, triethanolamine lauryl sulfate, triethanolamine laureth sulfate, lauryl sarcosine, cocoyl sarcosine, sodium lauryl sarcosinate, sodium lauroyl sarcosinate, triethylamine lauryl sulfate, triethylamine laureth sulfate, diethanolamine lauryl sulfate, diethanolamine laureth sulfate, lauric monoglyceride sodium sulfate, ammonium cocoyl sulfate, ammonium lauroyl sulfate, sodium cocoyl sulfate, sodium lauroyl sulfate, sodium cocoyl isethionate, potassium cocoyl sulfate, potassium lauryl sulfate, monoethanolamine cocoyl sulfate, monoetha nolamine lauryl sulfate, triethanolamine lauryl sulfate, sodium hydroxyethyl-2-decyl ether sulfates, sodium methyl-2-hydroxydecyl ether sulfates, sodium hydroxyethyl-2-dodecyl ether sulfates, sodium monoethoxylated lauryl alkyl sulfates, C12-C18 alkyl sulfonates, ethoxylated or native linear and ramified C12-C18 alcohol sulfates, ethoxylated or native linear and ramified C12-C18 alcohol sulfates, and mixtures thereof.

Typical cationic surfactants include but are not limited to quaternary ammonium salts having one or two alkyl chain comprising 10 to 22 carbon atoms, and optionally hydroxyl groups, and two to three alkyl groups having 1 to 4 carbon or hydroxyalkyl or hydroxyl groups, or alkoxy groups, having typically about 1 to about 10 ethylene oxide moieties, and an anion selected from the group of halides, hydroxides, acetates and methylsulfate, such as ditallowalkyldimethyl (or diethyl or dihydroxyethyl) ammonium chloride, ditallowalkyldimethylammonium methyl sulfate, methyl tallowalkyl amido ethyl, ditallowalkyldimethylammonium methyl sulfate, dihexadecylalkyl dimethyl (or diethyl, or dihydroxyethyl) ammonium chloride, dioctadecyl-alkyl dimethylammonium chloride, such as DODMAC (dioctadecyl dimethyl ammonium chloride), and dieicosylalkyl dimethylammonium chloride, ethyl-tallowalkyl imidazolinium methyl sulphate, ditallowalkyldimethylammonium methyl sulfate, methyl tallowalkyl amido ethyl tallowalkyl imidazolinium methyl sulfate, quaternary ammonium salts having one or two acyloxy-alkyl chains, one or two alkyl groups and/or one or two hydroxyalkyl groups, such as so-called esterquat (N-methyl-N,N,bis[2-(C16-C18-acetoxy)ethyl)]-N-(2-hydroxyethyl) ammonium methosulfate), diesterquat (N,N,N-trimethyl-N-[1,2-di-(C16-C18-acyloxy)propyl ammonium salts), DEEDMAC (N,N-dimethyl-N,N-bis([2-(-[(1-oxooctadecyl)oxy]ethyl) ammonium chloride, HEQ (N,N,N-trimethyl-N—[(Z)-2-hydroxy-3-[(1-oxo-octadec-9-enyl)oxy]] ammonium chloride, TEAQ (diquaternized methylsulfate salt of the reaction product between C10-C20 staturated and unsaturated fatty acids and triethanoloamine), alkylbenzyl dialkyl ammonium chloride, whereas the anion is selected from halides (such as chloride or bromide), hydroxy, ethylsulfate, acetate, carbonate, nitrate, phosphate and methylcarbonate.

Typical cationogenic surfactants include but are not limited to primary, secondary and tertiary amines, and ethoxylated fatty amines, such as lauriminopropyldimethyl amine, lauriminoethyldimethyl amine, myristyl amine, tridecyl amine, N-oleyl-1,3-propane diamine, ethoxylated N-tallow-1,3-propanediamine.

Typical zwitterionic surfactants include but are not limited to derivatives of aliphatic quaternary ammonium, phosphonium, and sulfonium compounds having linear or ramified alkyl, or alkenyl, or hydroxyl alkyl or alkoxy radicals, one of which having from about 8 to about 18 carbon atoms and another of which containing an anionic group selected from carboxyl, sulfonate, sulfate, succinate, phosphate or phosphonate groups. The alkoxy radicals include typically about 1 to about 10 ethylene oxide moieties or about 1 to about 3 glyceryl moieties. The hydroxyl alkyl radicals comprise typically alkylol moieties having 1 to 3 carbon atoms. A particular class of zwitterionic surfactant includes betaines comprising a quaternized cationic ammonium group and an anionic carboxylate group, separated by at least one methylene group, such as coco dimethylcarboxymethyl betaine, lauryl dimethyl carboxymethyl betaine, lauryl dimethyl alpha-carboxyethyl betaine, cetyl dimethyl carboxymethyl betaine, oleyl dimethyl gamma-carboxypropyl betaine, lauryl and stearyl bis-(2-hydroxyethyl) carboxymethyl betaine, oleyl dimethyl gamma-carboxypropyl betaine, and lauryl bis-(2-hydroxypropyl)-alpha-carboxyethyl betaine. Other betaines include amidoalkyl, sulfoalkyl and alkyl amidosufo betaines, wherein the alkyl moiety is typically an ethyl or a propyl moiety, such as cocoamidopropyl betaine, cocodimethylsulfopropyl betaine, lauryl dimethyl sulfoethyl betaine, lauryl bis-(2-hydroxyethyl) sulfopropyl betaine and the like.

Typical amphoteric surfactants include but are not limited to derivatives of primary, secondary and tertiary amines having linear or ramified alkyl or alkenyl radicals, one of which having from about 8 to about 18 carbon atoms and another of which containing an anionic group selected from carboxyl, sulfonate, sulfate, succinate, phosphate or phosphonate groups, such as sodium 3-dodecylimino propionate, sodium 3-dodecyliminopropane sulfonate.

Non-ionic surfactants include but are not limited to C4-C22 alkyl ethoxylates with about 1-25 ethylene oxide units, including the so-called narrow peaked alkyl ethoxylates, particularly ethoxylates and mixed ethoxylates/propoxylates, alkyl dialkyl amine oxides, alkyl polyglycosides, alkanoyl glucose amides, and mixtures thereof. Specific examples of non-ionic surfactants are the condensation products of aliphatic alcohols with from about 1 to about 22 moles of ethylene oxide. The alkyl chain of the aliphatic alcohol can either be straight or branched, primary or secondary, and generally contains from about 8 to about 18 carbon atoms, preferably C8 to C18 (e.g. C10) with 2 to 14 moles of ethylene oxide, such as the condensation product of C11-C15 linear secondary alcohol with 9 moles ethylene oxide, or the condensation product of C12-C14 primary alcohol with 6 moles ethylene oxide, or the condensation product of C14-C15 linear alcohol with 4 moles of ethylene oxide, or the condensation product of C13-C15 alcohol with 9 moles ethylene, or the condensation products of C13 alcohols and 2-21 moles of ethylene oxide. This category of non-ionic surfactant is referred to generally as "alkyl ethoxylates."

Other examples of non-ionic surfactants include the condensation products of ethylene oxide with a hydrophobic base formed by the condensation of propylene oxide with propylene glycol (e.g. PPG-1-PEG-9 Lauryl Glycol Ether).

Further examples of non-ionic surfactants are the polyethylene glycol sorbitol ethers containing 3-30 EO units (including, for example, sorbitol esters with oleic, myristic, stearic, palmitic acid, and the like).

Further examples of non-ionic surfactants are the condensation products of ethylene oxide (EO) with the product resulting from the reaction of propylene oxide and ethylene diamine.

Semi-polar non-ionic surfactants are a special category of non-ionic surfactants which include water-soluble amine oxides. These amine oxide surfactants in particular include C10-C18 alkyl dimethyl amine oxides and C8-C12 alkoxy ethyl dihydroxy ethyl amine oxides, such as NN-dihydroxyethyl-N-stearamine oxide, ethoxylated lauramide and lauryldimethylamine oxide.

Other non-ionic surfactants are alkyl polyglycosides including, for example, C8-C10 polyglycosides, such as C12-C16 alkyl polyglycosides, C8-C16 alkyl polyglycosides, C5 Amyl xyloside) and mixture of C5 Amyl, C8 Capryl, C12 Lauryl. The term "alkyl" as used hereinabove for the non-ionic sugar-based surfactant refers to saturated linear alkyl residues having 3 to 21 carbon atoms, including hexyl, octyl, decanyl, dodecanyl, tetradecanyl, hexadecanyl, and octadecanyl.

Further non-ionic surfactants include, for example, PEG 40 or PEG 400 hydrogenated castor oil.

Further non-ionic surfactants include glycerol-based surfactants having alkyl, alkenyl or hydroxyalkenyl residues having 5 to 21 carbon atoms, and different numbers of glyceryl moieties, such as octanoic acid hexaglyceryl ester, decanoic acid tetraglyceryl ester, riccinoleic acid hexaglyceryl ester, cocoic acids tetraglyceryl esters, and mixture thereof.

The perfumed products of the present invention may include acids or bases, or substances providing acidity or alkalinity, also referred to as acidity sources or alkalinity sources. The acids or acidity sources may be inorganic or organic. Inorganic acids and acidity sources may include hydrochloric acid, sulfuric acid, sulfamic acid, phosphoric acids and the like. Organic acids or acidity sources may include benzoic acid, citric acid, malic acid, and the like. The bases or alkalinity sources may also be inorganic or organic. Inorganic bases and alkalinity sources may include sodium hydroxide, ammonia, and salts comprising carbonates, phosphates, and the like.

The perfumed products of the present invention may include builders for reducing water hardness, such as phosphates, polyphosphates, polycarboxylates, sodium citrate, sodium carbonate, sodium silicate, sodium aluminosilicate (zeolite), and the like.

In many cases, the perfumed products of the present invention are liquid and may include further additives, such as solvents, fillers, texturing agents, such as thickener and rheological aids, distributing aids, anti-redeposition agents, preservative agents, deodorizing agents, cosmetic active ingredients, surface enhancing agents, In a particular embodiment of the present invention there is provided a perfumed product comprising a fragrance composition as herein defined and at least one solvent selected from water-soluble solvents, or water-insoluble, or partially water-soluble solvents.

Water-soluble co-solvents include, but are not limited to, ethanol, 1-propanol, 2-propanol, 1-butanol, 1,2-propane diol, 1,3-propane diol, 1,2-butanediol, 1,2-pentandiol 1,2-hexanediol, 1,2-heptanediol, 2-methyl-pentan-2,4-diol, carbitol, glycol ethers, such as propylene glycol, dipropylene glycol, 1,3-propanediol, glycol esters and glycol ethers, such as dipropylene glycol methyl ether acetate, dipropylene glycol methyl ether, propylene glycol n-butyl ether, diethylene glycol butyl ether, hexylene glycol, methyl methoxy butanol, (+/−)-2,2-dimethyl-4-hydroxymethyl-1,3-dioxolane, glycerine, dimethyl isosorbide, triethyl citrate and mixtures thereof.

Water-insoluble or partially insoluble solvents include, but are not limited to, isopropyl myristate, methyl myristate, alkyl esters, such as methyl linoleate, methyl palmitate, ethyl laurate, ethyl linoleate, ethyl oleate, ethyl octanoate, dibenzyl ether and diethyl phtalate, dibasic ester DBE (blend composed of diisobutyl glutarate, diisobutyl succinate, and diisobutyl adipate, commercially available from Solvay, or blend composed of diisobutyl glutarate, and diisobutyl adipate, commercially available from Invista, and hydrocarbons.

In a particular embodiment of the present invention there is provided a perfumed product comprising the fragrance composition of the present invention and at least one texturing agent and/or colloid stabilizer, selected from rheology modifiers, thickener, gel-forming agents, thixotropic agents, and dispersing agents.

These texturing agents and/or colloid stabilizers are typically water soluble of partially water soluble, or surface active polymers. These polymers include, but are not limited to quaternized hydroxyethyl cellulose, poly(diallyl ammonium chloride-co-acrylamide), quaternized guar gum, poly (acrylamidopropyltrimethyl amonium chloride-co-acrylamide) copolymers, poly(methacrylamidopropyltrimethyl ammonium chloride), polyethyleneimine, poly[(3-methyl-1-vinylimidazolium methyl sulfate)-co-(1-vinylpyrrolidone, cationic polyamines, cationic polyacrylamide, poly(trimethylaminoethyl methacrylate), poyl(vinylamine, poly(dimethyldiallyl ammonium chloride), also called poly(DADMAC), chitosan, carboxymethyl cellulose, xanthan gum, acacia gum, ghatti gum, tragaganth gum, Arabic gum, sodium alginate, ethoxylated alginate, gelatine, dextran, hydroxythyl cellulose, hydroxypropyl cellulose, hydroxypropyl methylcellulose, poly(ethylene oxide), poly(ethylene oxide-b-propylene oxide) block-copolymers, polyacrylamide, polyacrylic acid or carbomers, sodium polyacrylate, acrylates copolymer, acrylates crosspolymer-4, acrylates crosspolymer-3, polyacrylate-2 crosspolymer, and polyacrylate-14, crosslinked acrylates/C10-30 alkyl acrylate copolymers, polyvinyl alcohol, polyvinyl pyrrolidone, pectin, and modified.

In a particular embodiment of the present invention is provided a perfumed product, for example a hair care product, comprising the fragrance composition of the present invention and at least one silicone, selected from, but not limited to dimethicone, poly(dimethylsiloxane), amino-silicone, such as amodimethicone, trialkylammonium-silicone salts, ethoxylated silicones and the like.

In a particular embodiment of the present invention is provided a perfumed product comprising the fragrance composition of the present invention and at least one active cosmetic ingredient selected from, but not limited to emollients, moisturizing agents, anti-wrinkle agents, exfoliating agents, sunscreen agents, dyes, pigments, talcum, conditioning agents, hair styling agents, and antidandruff agents.

In a particular embodiment of the present invention is provided a perfumed product comprising a fragrance composition of the present invention and at least one fabric enhancing agent, selected from, but not limited to softening agents, optical brighteners and antistatic agents.

In a particular embodiment of the present invention is provided a perfumed product comprising a fragrance composition of the present invention and at least one preservative selected from, but not limited to butylated hydroxyanisole (BHA), butylated hydroxytoluene (BHT), dilauryl thiodipropionate, alkyl parabene, tocopherols and the like. In another embodiment, a suitable preservative includes a combination of benzisothiazolone (BIT), methylisothiazolone (MIT) and/or laurylamine dipropylenediamine (BDA), and mixtures thereof, and mixtures of NN'-dihydroxymethyl urea and 1,6-dihydroxy-2,5-dioxo-hexane.

In a particular embodiment of the present invention is provided a perfumed product comprising a fragrance composition of the present invention and at least one deodorizing agent selected from, but not limited to zinc derivatives, essential oils, sodium undecylenate, methyl undecylenate, 2-hydroxypropyl beta cyclodextrin, soyethyl morpholinium ethosulfate, crotonates and fumarates, and alkylene carbonates.

In a particular embodiment of the present invention is provided a perfumed product, for example home care products, comprising the fragrance composition of the present invention and at least one solubilized, water soluble uncomplexed cyclodextrin selected from, but not limited to alpha-cyclodextrin, beta-cyclodextrin, gamma cyclodextrin and/or their derivatives, and/or mixture thereof. Cyclodextrin derivatives include, but are not limited to methoxy, ethoxy cyclodextrins, hydroxyl ethyl cyclodextrins, hydroxypropyl cyclodextrins, cationic cyclodextrins, such as 2-hydroxy-3-(trimethylammonium) propyloxy cyclodextrins, anionic cyclodextrins, such as carboxymethyl cyclodextrins and cyclodextrin sulfates and the like.

In one embodiment of the present invention, the perfumed product is an all-purpose cleaner (APC) comprising typically from about 1 to about 25% by weight or, preferably from about 2 to about 20% by weight of anionic and/or non-ionic surfactant, preferably selected from, but not limited to sodium alkyl sulfonates and alkyl ethoxylates; up to about 10% by weight, preferably up to about 6% by weight soaps, for sample sodium fatty acid carboxylates; up to about 15% by weight, preferably up to about 10% by weight of alkalinity sources, for example sodium carbonate; up to about 10% by weight inorganic builders, for example sodium citrate-citric acid mixture; from about 0 to about 2% by weight organic builders, for example sodium polycarboxylate; from about 0.0001 to about 0.5% by weight, preferably from about 0.0003 to about 0.1% by weight of one or more preservative(s); and, optionally, up to about 5% by weight of one or more water-soluble solvent(s), citric acid, triethanolamine, sodium hydroxide, potassium hydroxide, ammonia, and/or oils, and the fragrance composition in 0.05 to 2% by weight, more particularly from about 0.1 to 1.5% by weight and still more particularly from about 0.25 to 1% by weight.

In order to further illustrate the present invention and the advantages thereof, the following specific examples and comparative example green, it being understood that same are intended only as illustrative and non-limiting.

EXAMPLES

The following examples are given solely for the purpose of illustration and are not to be construed as limitations of the present invention, as many variations of the invention are possible without departing from the spirit and scope of the present disclosure.

Example 1 Perfume Compositions

A series of perfumes were prepared with various combinations of GROUP B and GROUP C ingredients and various combinations of opposing ingredients within these groups. The characteristic features of these perfumes are shown in Table 2. Two comparative examples are also shown.

TABLE 2

Proportions of opposing group B and C ingredients

| | GROUP B ingredients (wet, initial, bloom) | GROUP C ingredients (dry, long-lasting) |
|---|---|---|
| Perfume 1 Opposing ingredients | ALDEHYDE C 10 DECYLIC (*CITRUS*/ALDEHYDIC)<br>ALDEHYDE C 8 OCTYLIC (*CITRUS*/ALDEHYDIC)<br>CYCLAL C (*CITRUS*/ALDEHYDIC)<br>DIPENTENTE (*CITRUS*/ALDEHYDIC)<br>LIMONENE LAEVO (*CITRUS*/ALDEHYDIC) | AMBERMAX (WOODY/AMBERY)<br>CEDRYL METHYL ETHER (WOODY)<br>IONONE BETA (FLORAL)<br>ISO E SUPER (WOODY) |
| Opposing ingredients % | 42.6% by weight | 23.2% |
| Other ingredients % | 10.4% by weight | 4.4% by weight |
| Total ingredients % | 53.0% by weight | 27.6% by weight |
| Perfume 2 Opposing ingredients | ALDEHYDE C 10 DECYLIC (*CITRUS*/ALDEHYDIC)<br>ALDEHYDE C 7 HEPTYLIC (ALDEHYDIC)<br>ALDEHYDE C 8 OCTYLIC (ALDEHYDIC)<br>ALDEHYDE C 9 NONYLIC (ALDEHYDIC)<br>DECENAL-4-TRANS (*CITRUS*/ALDEHYDIC)<br>LIMONENE LAEVO (*CITRUS*/ALDEHYDIC)<br>TRICYCLAL (*CITRUS*/ALDEHYDIC) | AMYL SALICYLATE (FLORAL)<br>CASHMERAN (MUSKY)<br>COUMARIN (SWEET)<br>ETHYL VANILLIN (SWEET)<br>HABANOLIDE (MUSKY)<br>HELIOTROPINE (SWEET) |
| Opposing ingredients % | 21.8% by weight | 26% by weight |
| Other ingredients % | 28.7% by weight | 17.5% by weight |
| Total ingredients % | 50.5% by weight | 43.5% by weight |
| Perfume 3 Opposing ingredients | ALLYL OENANTHATE (FRUITY)<br>ETHYL BUTYRATE (FRUITY)<br>ETHYL CAPRYLATE (FRUITY)<br>ETHYL METHYL-2-BUTYRATE (FRUITY)<br>ISOAMYL ACETATE (FRUITY)<br>ISOAMYL BUTYRATE (FRUITY) | AMYL SALICYLATE (FLORAL)<br>BENZYL SALICYLATE (FLORAL)<br>COUMARIN (SWEET)<br>ETHYL MALTOL (SWEET)<br>ETHYL VANILLIN (SWEET) |
| Opposing ingredients % | 26.9% by weight | 26.5% by weight |
| Other ingredients % | 21.1% by weight | 23.8% by weight |
| Total ingredients % | 48% by weight | 50.3% by weight |
| Perfume 4 Opposing ingredients | CYMENE PARA (AROMATIC/HERBAL)<br>EUCALYPTOL (AROMATIC/HERBAL)<br>FENCHYL ALCOHO (AROMATIC/HERBAL)<br>FRESKOMENTHE (AROMATIC/HERBAL)<br>ISOMENTHONE DL (AROMATIC/HERBAL)<br>LINALYL ACETATE (AROMATIC/HERBAL)<br>PINENE ALPHA (AROMATIC/HERBAL) | AMBERMAX (WOODY/AMBERY)<br>CASHMERAN (MUSKY)<br>COUMARIN (SWEET)<br>EVERNYL (WOODY/AMBERY)<br>IONONE BETA (FLORAL)<br>ISO E SUPER (WOODY/AMBERY)<br>ISORALDEINE 70 (FLORAL)<br>JAVANOL (WOODY/AMBERY)<br>KARANAL (WOODY AMBERY)<br>METHYL CEDRYL KETONE (WOODY/AMBERY)<br>PATCHOULI OIL (WOODY/AMBERY) |
| Opposing ingredients % | 21.5% by weight | 31% by weight |
| Other ingredients % | 20% by weight | 19.7% by weight |
| Total ingredients % | 41.5% by weight | 40.7% by weight |
| Perfume 5 (comparative example) | BORNYL ACETATE (AROMATIC/HERBAL)<br>ALDEHYDES C 8 TO C 10 (*CITRUS*/ALDEHYDIC)<br>LIMONENE (*CITRUS*/ALDEHYDIC)<br>P-CIMENE, TERPINENE, PINENE ALPHA, PINENE BETA (AROMATIC HERBAL) | ORANGER CRYSTAL (SWEET)<br>COUMARIN (SWEET)<br>ISO E SUPER (WOODY/AMBERY)<br>DODECALACTONE (FRUITY)<br>LILIAL, CYCLAMEN ALDEHYDE (FLORAL) |

TABLE 2-continued

| Proportions of opposing group B and C ingredients | | |
|---|---|---|
| | GROUP B ingredients (wet, initial, bloom) | GROUP C ingredients (dry, long-lasting) |
| | ROSE OXIDE (GREEN) TRICYCLAL (GREEN) | |
| Opposing ingredients % | 35% by weight | 0.6% by weight |
| Other ingredients % | 15.5% by weight | 18.4% by weight |
| Total ingredients % | 50.0% by weight | 19.0% by weight |

Example 2 Product

A hard surface cleaner was prepared by mixing 2% by weight of HOSTAPUR SAS 60 (Na C14-17 sec alkyl sulphonate), 2% by weight LUTENSOL TO 10 (PEG 10-C13 oxo-alcohol), 1% by weight triethanolamine, 0.3% by weight citric acid, 0.2% by weight sodium hydroxide, Parmetol DF 35 (preservative), x % by weight of fragrance, and dionized water to complete to 100% by weight.

The level of fragrance was varying between 0.25% by weight and 0.65% by weight, depending on the sample evaluated (see Example 3)

Example 3 Odour Assessment and Evaluation Results

The testing was carried out in small booths (10 m3 booths, 21° C., 50% RH) specifically designed with a constant airflow. The booths were closed during testing, with the doors sealed.

The application sample was prepared just prior to assessment by pouring 60 ml of neat product into 5 L (1.2% by volume) of water having a temperature of 45° C., which was contained within a 10 L mop bucket. The solution was stirred five times with a mop and the bucket and mop were left in the booth during the assessment.

For the 1 hour after application sample the product was diluted in warm tap water (at 45° C.) at 1.2% by volume and an hour before assessment. 60 ml of this diluted product was applied directly to the booth floor. It was evenly spread using a gloved hand, over an area of 65 cm×65 cm. These booths also contained a mop and bucket which didn't contain any product to ensure all booths looked the same.

Each sample was coded with a random code number. The order of samples assessed by the panelists was pre-determined using a fully balanced randomization.

The system was assessed through the porthole (window) of the booths. The panelists were presented with 2 sets of 3 samples and instructed that, in each triad, two samples were identical and one was different. Each sample of the triad was smelt according to a fully balanced pre-determined randomization, and the panelists were instructed to select the odd sample.

The intensity of the odor was on a linear scale (0-100).

The results are reported in Table 3

TABLE 3

| Results of sensory evaluation | |
|---|---|
| Perfume | Comments |
| Perfume 1 (according to the present invention) | Difference of odor direction between initial, wet stage and 1 hour dry stage perceived as significant by panelists. |

TABLE 3-continued

| Results of sensory evaluation | |
|---|---|
| Perfume | Comments |
| Perfume 2 (according to the present invention) | The intensities of the odor perceived between the initial, wet stage (44/100) and 1 hour dry stage (39/100) were perceived as comparable. Difference of odor direction between initial, wet stage and 1 hour dry stage perceived as significant by panelists |
| Perfume 5 (comparative example) | The intensities of the odor perceived between the initial, wet stage (41/100) and 1 hour dry stage (39/100) were perceived as comparable. No significant odor difference between initial, wet stage and 1 hour dry stage perceived by panelists. The intensity of odor perceived on the wet stage (41/100) was stronger that the intensity of odor perceived after 1 hour on the dry stage (25/100). |

What is claimed is:

1. A fragrance composition for products providing perceptibly different odour characteristics from the wet stage through to the dry state, characterized in that:

a) greater than 0 to less than 20% by weight of the fragrance composition comprises perfumery ingredients having an equilibrium headspace concentration between 151 and 900 microgram/l at 25° C., defined as Group A ingredients; and b) more than 40% by weight of the fragrance composition comprises perfumery ingredients having an equilibrium headspace concentration higher than 900 microgram/l at 25° C., defined as Group B ingredients; and c) more than 25% by weight, of the fragrance composition comprises perfumery ingredients having an equilibrium headspace concentration lower than or equal to about 150 microgram/l at 25° C., defined as Group C ingredients;

wherein the percent (%) by weight refers to the total amount of perfume ingredients contained in said composition, wherein more than 15% by weight of perfumery ingredients are Group B ingredients that are perceivable during the wet stage of application, and more than 15% by weight of the perfumery ingredients are Group C ingredients that are perceivable during the dry stage of application, and the Group B ingredients that are perceivable during the wet stage of application and the Group C ingredients that are perceivable during the dry stage of application have mutually opposed odour characteristics.

2. The fragrance composition according to claim 1, wherein the mutually opposed odour characters are provided by a) Group B ingredients having FRUITY odour, GREEN odour, and/or HERBAL/AROMATIC; and b) Group C ingredients having AMBER/WOODY odour; FLORAL odour, SWEET odour, MUSKY odour, and/or FRUITY odour.

3. The fragrance composition according to claim 1, wherein the mutually opposed odour characters are provided by a) Group B ingredients having FLORAL odour; and c) Group C ingredients having AMBER/WOODY odour, SWEET odour, MUSKY odour, and/or FRUITY odour.

4. The fragrance composition according to claim 2, wherein the FRUITY odour is provided by Group B perfumery ingredients selected from the group consisting of allyl hexanoate, ethyl hexanoate, allyl heptanoate, 3-methylbutyl acetate, 3-methylbut-2-en-1-yl acetate, pentyl butanoate, 6-methylheptan-3-one, 3-methylbutyl butanoate, 4-methylpent-4-en-2-yl 2-methylpropanoate, heptan-2-one, ethyl butanoate, ethyl 2-methylpentanoate, ethyl 2-methylbutanoate, (4S)-4,7,7-trimethyl-6-thiabicyclo[3.2.1]octane, 2-methyl-4-propyl-1,3-oxathiane, (Z)-hex-3-en-1-yl methyl carbonate, (Z)-hex-3-en-1-yl acetate, hexyl acetate, 2,6-dimethylhept-5-enal, benzaldehyde, and mixtures thereof.

5. The fragrance composition according to claim 2, wherein the CITRUS/ALDEHYDIC odour is provided by Group B perfumery ingredients selected from the group consisting of 3,7-dimethyloct-6-enal, 4,7-dimethyloct-6-en-3-one, 6,6-dimethoxy-2,5,5-trimethylhex-2-ene, 1-phenylethanethiol, 1-methyl-4-(prop-1-en-2-yl)cyclohex-1-ene, (4R)-1-methyl-4-(1-methylvinyl)cyclohexene, 1-methyl-4-(propan-2-ylidene)cyclohex-1-ene, octanal, nonanal, 3,5,5-trimethylhexanal, (E)-dec-4-enal, decanal, and mixtures thereof.

6. The fragrance composition according to claim 2, wherein the GREEN odour is provided by Group B perfumery ingredients selected from the group consisting of hexanal, (Z)-hex-3-en-1-ol, 4-vinylcyclohex-1-enecarbaldehyde, 2,4-dimethylcyclohex-3-enecarbaldehyde, 2,4-dimethylcyclohex-3-enecarbaldehyde, 7-methyl-3-methyleneocta-1,6-diene, (3E,5Z)-undeca-1,3,5-triene, (2E,6Z)-nona-2,6-dienal, 4-methyl-2-(2-methylprop-1-en-1-yl)tetrahydro-2H-pyran, and mixtures thereof.

7. The fragrance composition according to claim 2, wherein the HERBAL/AROMATIC odour is provided by Group B perfumery ingredients selected from the group consisting of (2S)-1,3,3-trimethylbicyclo[2.2.1]heptan-2-yl acetate, (1S,2R,4R)-1,3,3-trimethylbicyclo[2.2.1]heptan-2-ol, (1S,4S)-1,7,7-trimethylbicyclo[2.2.1]heptan-2-one, (2S,4S)-1,7,7-trimethylbicyclo[2.2.1]heptan-2-yl acetate, 2,6,6-trimethylbicyclo[3.1.1]hept-2-ene, 6,6-dimethyl-2-methylenebicyclo[3.1.1]heptane, 1-methyl-4-propan-2-ylbenzene, 1-methyl-4-propan-2-ylcyclohexa-1,4-diene, 2,2,6-trimethyl-6-vinyltetrahydro-2H-pyran, 3,7-dimethylocta-1,6-dien-3-yl acetate, 2,6-dimethyloct-7-en-2-ol, (1s,4s)-1,3,3-trimethyl-2-oxabicyclo[2.2.2]octane, 2-(sec-butyl)cyclohexanone, 2-isopropyl-5-methylcyclohexanone, 2-isopropyl-5-methylcyclohexanone, and mixtures thereof.

8. The fragrance composition according to claim 3, wherein the FLORAL odour is provided by Group B perfumery ingredients selected from the group consisting of methyl 2-hydroxybenzoate, benzyl acetate, 1-phenylethanone, 2,6-dimethyloct-7-en-2-ol, 2,6-dimethylheptan-2-ol, 3,7-dimethylocta-1,6-dien-3-ol, 3,7-dimethyloctan-3-ol, methyl benzoate, 1-methoxy-4-methylbenzene, 2-(2-hydroxypropan-2-yl)-5-methylcyclohexanol, (Z)-3,4,5,6,6-pentamethylhept-3-en-2-one, and mixtures thereof.

9. The fragrance composition according to claim 2, wherein the FLORAL odour is provided by Group C perfumery ingredients selected from the group consisting of 4-(2,6,6-trimethylcyclohex-1-en-1-yl)butan-2-one, 7,9-dimethylspiro[5.5]undecan-3-one, (E)-4-(2,6,6-trimethylcyclohex-1-en-1-yl)but-3-en-2-one, (E)-4-(2,5,6,6-tetramethylcyclohex-2-en-1-yl)but-3-en-2-one, (E)-3-methyl-4-(2,6,6-trimethylcyclohex-2-en-1-yl)but-3-en-2-one, methyl 2-(methylamino)benzoate, methyl 2-aminobenzoate, 1-(2-naphtalenyl)-ethanone, 2-ethoxynaphthalene, 2-methoxynaphthalene, (4-methoxyphenyl)methanol, 2-hexylcyclopent-2-enone, (Z)-3-methyl-2-(pent-2-en-1-yl)cyclopent-2-enone, (Z)-6-(pent-2-en-1-yl)tetrahydro-2H-pyran-2-one, pentyl 2-hydroxybenzoate, hexyl 2-hydroxybenzoate, (4Z)-hept-4-en-2-yl 2-hydroxybenzoate, benzyl 2-hydroxybenzoate, 4-cyclohexyl-2-methylbutan-2-ol, tetrahydro-4-methyl-2-(2-methylpropyl)-2H-pyran-4-ol, (4E)-9-hydroxy-5,9-dimethyl-4-decenal, 3-(4-isopropylphenyl)-2-methylpropanal, 3-(4-(tert-butyl)phenyl)propanal, 3-(benzo[d][1,3]dioxol-5-yl)-2-methylpropanal, (E)-4-((3aS,7aS)-hexahydro-1H-4,7-methanoinden-5(6H)-ylidene) butanal, 3-(4-ethylphenyl)-2,2-dimethylpropanal, tetrahydro-4-methyl-2-(2-methylpropyl)-2H-pyran-4-ol, 3-(4-(tert-butyl)phenyl)-2-methylpropanal, 2,2-dimethyl-3-(m-tolyl)propan-1-ol, 4-(4-methylpent-3-en-1-yl)cyclohex-3-enecarbaldehyde, dec-9-en-1-ol, 3-(3-isopropylphenyl) butanal, 3-(4-isobutyl-2-methylphenyl)propanal, (E)-3-phenylprop-2-en-1-ol, 3-phenylpropan-1-ol, (1-methyl-2-(5-methylhex-4-en-2-yl)cyclopropyl)methanol, 3,7-dimethyloct-6-en-1-ol, (E)-3,7-dimethylocta-2,6-dien-1-ol, 3-methyl-5-phenylpentan-1-ol, 2,2,2-trichloro-1-phenylethyl acetate, 2-cyclohexylidene-2-phenylacetonitrile, 2-methyl-4-phenylbutan-2-ol, and mixtures thereof.

10. The fragrance composition according to claim 2, wherein the WOODY/AMBERY odour is provided by Group C perfumery ingredients selected from the group consisting of 3-methoxy-5-methylphenol, (Z)-1-(cyclooct-3-en-1-yl)propan-1-ol, methyl 2,4-dihydroxy-3,6-dimethylbenzoate, (1-methyl-2-(((1R,3R)-2,2,3-trimethylcyclopentyl)methyl)cyclopropyl)methanol, 7-methoxy-3,7-dimethyloctan-2-ol, (E)-2-methyl-4-(2,2,3-trimethyl-1-cyclopent-3-enyl)but-2-en-1-ol, (E)-3-methyl-5-(2,2,3-trimethylcyclopent-3-en-1-yl)pent-4-en-2-ol, (1-methyl-2-((1,2,2-trimethylbicyclo[3.1.0]hexan-3-yl)methyl) cyclopropyl)methanol, (E)-3,3-dimethyl-5-(2,2,3-trimethyl-3-cyclopenten-1-yl)-4-penten-2-ol, (E)-2-ethyl-4-(2,2,3-trimethylcyclopent-3-en-1-yl)but-2-en-1-ol, 3-((1R,2S,4R,6R)-5,5,6-trimethylbicyclo[2.2.1]heptan-2-yl)cyclohexanol, (E)-2-methyl-4-(2,2,3-trimethyl-1-cyclopent-3-enyl)but-2-en-1-ol, 3-methyl-5-(2,2,3-trimethylcyclopent-3-en-1-yl) pentan-2-ol, 4-(tert-butyl)cyclohexyl acetate, 2-(tert-pentyl) cyclohexyl acetate, 2-(4-methylcyclohexyl)propan-2-yl acetate, (1S,2R,5R)-2-ethoxy-2,6,6-trimethyl-9-methylenebicyclo[3.3.1]nonane, ((1S,8aR)-1,4,4-trimethyl-2,3,3a,4,5,8-hexahydro-1H-5,8a-methanoazulen-6-yl)methanol, (1S,6R,8aR)-1,4,4,6-tetramethyloctahydro-1H-5,8a-methanoazulen-6-yl acetate, 2-(3,8-dimethyl-1,2,3,4,5,6,7,8-octahydroazulen-5-yl)propan-2-yl acetate, 1-(2,3,8,8-tetramethyl-1,2,3,4,5,6,7,8-octahydronaphthalen-2-yl) ethanone, 1-(2,3,8,8-tetramethyl-1,2,3,4,5,6,7,8-octahydronaphthalen-2-yl)ethanone, 4-(1-ethoxyvinyl)-3,3,5,5-tetramethyl cyclohexanone, 1-(1,2,8,8-tetramethyl-1,2,3,4,5,6,7,8-octahydronaphthalen-2-yl)ethanone, 1-((1S,8aS)-1,4,4,6-tetramethyl-2,3,3a,4,5,8-hexahydro-1H-5,8a-methanoazulen-7-yl)ethanone, 1-((1S,8aS)-1,4,4,6-tetramethyl-2,3,3a,4,5,8-hexahydro-1H-5,8a-methanoazulen-7-yl)ethanone, N-ethyl-N-(m-tolyl)

propionamide, 1-((2-(tert-butyl)cyclohexyl)oxy)butan-2-ol, r 3,8,8,11a-tetramethyldodecahydro-1H-3,5a-epoxynaphtho[2,1-c]oxepine, (4aR,5R,7aS,9R)-Octahydro-2,2,5,8,8,9a-hexamethyl-4H-4a,9-methanoazuleno[5,6-d]-1,3-dioxole, (ethoxymethoxy)cyclododecane, (4Z,8Z)-1,5,9-trimethyl-13-oxabicyclo[10.1.0]trideca-4,8-diene, 2-(2-(3,3,5-trimethylcyclohexyl)acetyl)cyclopentanone, 3a-ethyl-6,6,9a-trimethyldodecahydronaphtho[1,2-c]furan, 5-(sec-butyl)-2-(2,4-dimethylcyclohex-3-en-1-yl)-5-methyl-1,3-dioxane, 2-(sec-butyl)-1-methylcyclohexyl acetate, 2,4-dimethyl-2-(5,5,8,8-tetramethyl-5,6,7,8-tetrahydronaphthalen-2-yl)-1,3-dioxolane, 1-(2,2,6-trimethylcyclohexyl)hexan-3-ol, 2,2',3,7,7-pentamethylspiro[bicyclo[4.1.0]heptane-2,5'-[1,3]dioxane], (7,7,8,8-tetramethyloctahydro-2,3b-methanocyclopenta[1,3]cyclopropa[1,2]benzen-4-yl)methyl acetate, (1R,2S,4R)-2'-isopropyl-1,7,7-trimethylspiro[bicyclo[2.2.1]heptane-2,4'-[1,3]dioxane], (1R,6S,8aS)-6-methoxy-1,4,4,6-tetramethyloctahydro-1H-5,8a-methanoazulene, 2,4a,5,8a-tetramethyl-1,2,3,4,4a,7,8,8a-octahydronaphthalen-1-yl formate, Patchouli oils; 4,8a,9,9-tetramethyldecahydro-1,6-methanonaphthalen-1-ol, and mixtures thereof.

11. The fragrance composition according to claim 2, wherein the SWEET odour is provided by Group C perfumery ingredients selected from the group consisting of 2H-chromen-2-one, octahydro-2H-chromen-2-one, 3-hydroxy-2-methyl-4H-pyran-4-one, 2-ethyl-3-hydroxy-4H-pyran-4-one, benzo[d][1,3]dioxole-5-carbaldehyde, 4-formyl-2-methoxyphenyl isobutanoate, 3-ethoxy-4-hydroxybenzaldehyde, 4-allyl-2-methoxyphenol, (E)-2-methoxy-4-(prop-1-en-1-yl)phenol, 4-allyl-2-methoxyphenyl acetate, (E)-1,2-dimethoxy-4-(prop-1-en-1-yl)benzene, 2-methoxy-4-propylphenol, 3-phenylprop-2-enyl 3-phenylprop-2-enoate, (2E)-3-phenylprop-2-enal, (E)-3-phenylprop-2-enenitrile, and mixtures thereof.

12. The fragrance composition according to claim 2, wherein the MUSKY odour is provided by Group C perfumery ingredients selected from the group consisting of (Z)-oxacycloheptadec-10-en-2-one, (Z)-cycloheptadec-9-enone, (Z)-3-methylcyclotetradec-5-enone, 1,4-dioxacycloheptadecane-5,17-dione, 4,6,6,7,8,8-hexamethyl-1,3,4,6,7,8-hexahydrocyclopenta[g]-isochromene, (E)-oxacyclohexadec-12-en-2-one, (Z)-3-methylcyclopentadec-5-enone, 1,4-dioxacyclohexadecane-5,16-dione, (E)-13-methyloxacyclopentadec-10-en-2-one, 2-(1-(3,3-dimethylcyclohexyl)ethoxy)-2-methylpropyl cyclopropanecarboxylate, (E)-2-((3,5-dimethylhex-3-en-2-yl)oxy)-2-methylpropyl cyclopropanecarboxylate, oxacyclohexadecan-2-one, (Z)-cyclohexadec-5-enone, 1,1,2,3,3-pentamethyl-2,3,6,7-tetrahydro-1H-inden-4(5H)-one, 1a,3,3,4,6,6-hexamethyl-1a,2,3,4,5,6,7,7a-octahydronaphtho[2,3-b]oxirene, cyclopentadecanone, 1-oxacycloheptadecan-2-one, and mixtures thereof.

13. The fragrance composition according to claim 2, wherein the FRUITY odour is provided by Group C perfumery ingredients selected from the group consisting of 6-pentyltetrahydro-2H-pyran-2-one, 5-hexyloxolan-2-one, 6-heptyltetrahydro-2H-pyran-2-one, 5-octyloxolan-2-one, 6-hexyltetrahydro-2H-pyran-2-one, 6-propyltetrahydro-2H-pyran-2-one, 5-pentyldihydrofuran-2(3H)-one, 4-methyl-5-pentyldihydrofuran-2(3H)-one, ethyl 6-acetoxyhexanoate, 4-(4-hydroxyphenyl)butan-2-one, ethyl methyl phenyl glycidate, 2-methyl-1-phenylpropan-2-yl butanoate, (E)-1-(2,6,6-trimethylcyclohex-1-en-1-yl)but-2-en-1-one, and mixtures thereof.

14. A consumer product comprising the fragrance composition according to claim 1.

15. The consumer product according to claim 14, wherein the fragrance composition is present at a level of from 0.05 to 5% by weight, by weight of the consumer product.

16. An all-purpose cleaner (APC) comprising from 0.05 to 2% by weight of the fragrance composition according to claim 1, 1 to 25% by weight or, preferably from 2 to 20% by weight of anionic and/or non-ionic surfactants, from 1 to 10% by weight of one or more soaps, from 1 to 15% by weight, preferably from 2 to 10% by weight of one or more alkalinity sources, from 1 to 10% by weight of one or more inorganic builders, from 0 to 2% by weight organic builders, and from 0.0001 to 0.5% by weight one or more preservative(s).

17. A method of applying a perfumed product to a substrate to reduce consumer perfume habituation to said perfume product by providing two perceptibly different odour impressions to the substrate, wherein a first odour impression is perceived during application of the perfumed product to the substrate and a second odour impression is perceived after the perfumed product has dried on the substrate, said method comprising the step of applying to the substrate a perfumed product containing a fragrance composition according to claim 1.

18. The consumer product according to claim 14, wherein the fragrance composition is present at a level of from 0.1 to 2.5% by weight.

19. The consumer product according to claim 18, wherein the fragrance composition is present at a level of 0.25 to 2% by weight.

20. The all-purpose cleaner (APC) of claim 16 comprising from 0.05 to 2% by weight of the fragrance composition, from 2 to 20% by weight of anionic and/or non-ionic surfactants, from 1 to 10% by weight of one or more soaps, from 2 to 10% by weight of one or more alkalinity sources, from 1 to 10% by weight of one or more inorganic builders, from 0 to 2% by weight organic builders, from 0.0001 to 0.5% by weight one or more preservative(s), and up to 5% by weight of one or more water-soluble solvent(s), citric acid, triethanolamine, sodium hydroxide, potassium hydroxide, ammonia, and/or oils.

* * * * *